US010788234B2

(12) United States Patent
Fumimoto et al.

(10) Patent No.: US 10,788,234 B2
(45) Date of Patent: Sep. 29, 2020

(54) HEIGHT DIFFERENCE SETTING SYSTEM

(71) Applicant: Daikin Industries, LTD., Osaka-Shi, Osaka (JP)

(72) Inventors: Takuya Fumimoto, Osaka (JP); Daisuke Nogami, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/493,353

(22) PCT Filed: Mar. 23, 2018

(86) PCT No.: PCT/JP2018/011661
§ 371 (c)(1),
(2) Date: Sep. 12, 2019

(87) PCT Pub. No.: WO2018/180972
PCT Pub. Date: Oct. 4, 2018

(65) Prior Publication Data

US 2020/0141605 A1 May 7, 2020

(30) Foreign Application Priority Data

Mar. 31, 2017 (JP) ..... 2017-070839

(51) Int. Cl.
*F24F 11/49* (2018.01)
*F24F 11/64* (2018.01)
(Continued)

(52) U.S. Cl.
CPC ..... *F24F 11/49* (2018.01); *F24F 1/32* (2013.01); *F24F 11/64* (2018.01); *F24F 11/65* (2018.01); *F24F 11/83* (2018.01)

(58) Field of Classification Search
CPC .. F24F 11/49; F24F 11/30; F24F 11/50; F24F 11/64; F24F 11/65; F24F 11/83
See application file for complete search history.

(56) References Cited

U.S. PATENT DOCUMENTS

2014/0223941 A1* 8/2014 Nishimura ..... F25B 49/02 62/190
2015/0330646 A1 11/2015 Matsumoto
(Continued)

FOREIGN PATENT DOCUMENTS

CN 105008815 A * 10/2015 ..... F24F 11/30
CN 105008815 A 10/2015
(Continued)

OTHER PUBLICATIONS

International Search Report of corresponding PCT Application No. PCT/JP2018/0011661 dated May 22, 2018.
International Preliminary Report of corresponding PCT Application No. PCT/JP2018/011661 dated Mar. 23, 2018.

*Primary Examiner* — Marc E Norman
*Assistant Examiner* — Schyler S Sanks
(74) *Attorney, Agent, or Firm* — Global IP Counselors, LLP

(57) ABSTRACT

Provided is a height difference setting system capable of setting a transport capacity of refrigerant in an appropriate state.
A height difference setting system (1) is constituted by a plurality of components. Information is communicated between the components, and accordingly a height difference between an outdoor unit (8) and an indoor unit (9) that constitute an air conditioner (7) installed on or in a building (6) is set. The height difference setting system (1) includes components that function as an outdoor unit height information obtaining unit (2), an indoor unit height information obtaining unit (3), a height difference setting unit (4), and a transport capacity adjusting unit (5). The outdoor unit height information obtaining unit (2) and the indoor unit height information obtaining unit (3) obtain outdoor unit height information indicating a height of an installation place of the outdoor unit (8) and indoor unit height information indicat-
(Continued)

ing a height of an installation place of the indoor unit (9), respectively. The height difference setting unit (4) sets a height difference between the outdoor unit and the indoor unit on the basis of the outdoor unit height information and the indoor unit height information. The transport capacity adjusting unit (5) adjusts a transport capacity of refrigerant to be transported from the outdoor unit to the indoor unit on the basis of the height difference set by the height difference setting unit (4).

12 Claims, 22 Drawing Sheets

(51) Int. Cl.

| | |
|---|---|
| ***F24F 11/65*** | (2018.01) |
| ***F24F 11/83*** | (2018.01) |
| ***F24F 1/32*** | (2011.01) |

(56) References Cited

U.S. PATENT DOCUMENTS

| | | | |
|---|---|---|---|
| 2016/0327303 | A1 | 11/2016 | Tomita et al. |
| 2017/0307246 | A1 | 10/2017 | Ohara et al. |

FOREIGN PATENT DOCUMENTS

| | | | |
|---|---|---|---|
| JP | 10-153335 | A | 6/1998 |
| JP | 2002-267232 | A | 9/2002 |
| JP | 2006-90631 | A | 4/2006 |
| JP | 2013-76531 | A | 4/2013 |
| JP | 2015-117854 | A | 6/2015 |
| JP | 2015-166644 | A | 9/2015 |
| JP | 2016-197010 | A | 11/2016 |
| WO | 2016/117371 | A1 | 7/2016 |

* cited by examiner

| IDENTIFICATION INFORMATION D | HEIGHT INFORMATION |
|---|---|
| OUTDOOR UNIT 1 | 15m |
| INDOOR UNIT 1-3 | 15m |
| INDOOR UNIT 1-2 | 10m |
| INDOOR UNIT 1-1 | 5m |

FIG. 13

| DESIGN INFORMATION L | |
|---|---|
| IDENTIFICATION INFORMATION D | HEIGHT INFORMATION |
| OUTDOOR UNIT 1 | 15m |
| INDOOR UNIT 1-3 | 15m |
| INDOOR UNIT 1-2 | 10m |
| INDOOR UNIT 1-1 | 5m |

FIG. 16

| DESIGN INFORMATION D | |
|---|---|
| SECOND IDENTIFICATION INFORMATION D2 | HEIGHT INFORMATION |
| OUTDOOR UNIT A | 15m |
| INDOOR UNIT A-3 | 15m |
| INDOOR UNIT A-2 | 10m |
| INDOOR UNIT A-1 | 5m |

FIG. 19

HEIGHT DIFFERENCE SETTING SYSTEM

BACKGROUND ART

When there is a height difference between an indoor unit and an outdoor unit at the time of installing an air conditioner, a transport capacity of refrigerant is adjusted by considering an influence of the height difference. Specifically, when there is a height difference between the indoor unit and the outdoor unit, the transport capacity of refrigerant is set to be higher than when there is no height difference (see, for example, Patent Literature 1 (Japanese Unexamined Patent Application Publication No. 10-153335)).

SUMMARY OF THE INVENTION

Technical Problem

However, it is necessary to pay attention to the followings to adjust the transport capacity of refrigerant by considering the height difference between the indoor unit and the outdoor unit. First, (1) a man-hour for input to set a height difference is needed. In addition, (2) an on-site worker may make an input mistake when setting a height difference. In addition, (3) there is a possibility that an on-site worker will not set a height difference. In addition, (4) even if a height difference is once set, the transport capacity of refrigerant may become inappropriate depending on operation conditions of the indoor unit.

When the height difference is not appropriately set for the above reasons, the transport capacity of refrigerant becomes inappropriate. As a result, it may be impossible to maintain the cooling capacity and heating capacity of the air conditioner.

An object of the present invention is to provide a height difference setting system capable of setting a transport capacity of refrigerant in an appropriate state.

Solution to Problem

A height difference setting system according to a first aspect of the present invention is a height difference setting system in which a height difference between an outdoor unit and one or more indoor units associated with the outdoor unit is set by a management apparatus that communicates with either or both of the outdoor unit and each of the one or more indoor units. This height difference setting system includes an outdoor unit height information obtaining unit, an indoor unit height information obtaining unit, a height difference setting unit, and a transport capacity adjusting unit. The outdoor unit height information obtaining unit obtains outdoor unit height information indicating a height of an installation place of the outdoor unit. The indoor unit height information obtaining unit obtains indoor unit height information indicating a height of an installation place of the indoor unit. The height difference setting unit sets a height difference between the outdoor unit and the indoor unit on the basis of the outdoor unit height information and the indoor unit height information. The transport capacity adjusting unit adjusts, on the basis of the height difference set by the height difference setting unit, a transport capacity of refrigerant to be transported from the outdoor unit to the indoor unit. In this height difference setting system, the outdoor unit height information obtaining unit and the transport capacity adjusting unit are located in the outdoor unit. The indoor unit height information obtaining unit is located in the indoor unit. The height difference setting unit is located in the management apparatus.

The height difference setting system according to the first aspect is capable of setting the height difference between the outdoor unit and the indoor unit by using the management apparatus. Accordingly, the height difference setting system is capable of setting the transport capacity of refrigerant in an appropriate state on the basis of the height difference setting.

A height difference setting system according to a second aspect of the present invention is a height difference setting system in which a height difference between an outdoor unit and one or more indoor units associated with the outdoor unit is set by using a predetermined communication terminal that is capable of communicating with the outdoor unit and each of the one or more indoor units. This height difference setting system includes an outdoor unit height information obtaining unit, an indoor unit height information obtaining unit, a height difference setting unit, and a transport capacity adjusting unit. The outdoor unit height information obtaining unit obtains outdoor unit height information indicating a height of an installation place of the outdoor unit. The indoor unit height information obtaining unit obtains indoor unit height information indicating a height of an installation place of the indoor unit. The height difference setting unit sets a height difference between the outdoor unit and the indoor unit on the basis of the outdoor unit height information and the indoor unit height information. The transport capacity adjusting unit adjusts, on the basis of the height difference set by the height difference setting unit, a transport capacity of refrigerant to be transported from the outdoor unit to the indoor unit. In this height difference setting system, the outdoor unit height information obtaining unit and the indoor unit height information obtaining unit are located in the communication terminal. The height difference setting unit and the transport capacity adjusting unit are located in the outdoor unit.

The height difference setting system according to the second aspect has the above-described configuration and is thus capable of obtaining the outdoor unit height information and the indoor unit height information by using the communication terminal. Accordingly, the height difference setting system is capable of setting the height difference between the outdoor unit and the indoor unit on the basis of the outdoor unit height information and the indoor unit height information, and is thus capable of setting the transport capacity of refrigerant in an appropriate state on the basis of the height difference.

According to a height difference setting system according to a third aspect of the present invention, in the height difference setting system according to the second aspect, the indoor unit height information is transmitted from the communication terminal to the outdoor unit via the indoor unit.

The height difference setting system according to the third aspect is capable of obtaining the outdoor unit height information and the indoor unit height information by using the communication terminal.

According to a height difference setting system according to a fourth aspect of the present invention, in the height difference setting system according to the second aspect, the indoor unit is connected to a remote controller capable of wirelessly communicating with a peripheral device. The indoor unit height information is transmitted from the communication terminal to the remote controller through wireless communication and is transmitted to the outdoor unit via the remote controller and the indoor unit.

The height difference setting system according to the fourth aspect is capable of obtaining the indoor unit height information via the remote controller.

According to a height difference setting system according to a fifth aspect of the present invention, in the height difference setting system according to the second aspect to the fourth aspect, the outdoor unit and the indoor unit are managed by a management apparatus that communicates with the outdoor unit. The management apparatus is capable of communicating with the predetermined communication terminal. In this height difference setting system, the outdoor unit height information obtaining unit and the indoor unit height information obtaining unit are located in the communication terminal. The height difference setting unit is located in the outdoor unit. The outdoor unit height information and the indoor unit height information are transmitted from the communication terminal to the outdoor unit via the management apparatus.

The height difference setting system according to the fifth aspect is capable of obtaining the outdoor unit height information and the indoor unit height information by using the management apparatus and the communication terminal. Accordingly, the communication terminal that does not communicate with the outdoor unit and the indoor unit can be used.

According to a height difference setting system according to a sixth aspect of the present invention, in the height difference setting system according to the fifth aspect, the indoor unit has a two-dimensional code displayed thereon, the two-dimensional code including corresponding indoor unit height information. The indoor unit height information obtaining unit reads the two-dimensional code to obtain the indoor unit height information.

The height difference setting system according to the sixth aspect is capable of obtaining the indoor unit height information by using the two-dimensional code (QR code (registered trademark) or the like). Accordingly, the indoor unit height information can be easily obtained and thus the work load of an on-site worker or the like can be reduced.

A height difference setting system according to a seventh aspect of the present invention is a height difference setting system in which a height difference between an outdoor unit and one or more indoor units associated with the outdoor unit is set by a management apparatus that communicates with either or both of the outdoor unit and each of the one or more indoor units. This height difference setting system includes an outdoor unit height information obtaining unit, an indoor unit height information obtaining unit, a height difference setting unit, a transport capacity adjusting unit, and a design information storage unit. The outdoor unit height information obtaining unit obtains outdoor unit height information indicating a height of an installation place of the outdoor unit. The indoor unit height information obtaining unit obtains indoor unit height information indicating a height of an installation place of the indoor unit. The height difference setting unit sets a height difference between the outdoor unit and the indoor unit on the basis of the outdoor unit height information and the indoor unit height information. The transport capacity adjusting unit adjusts, on the basis of the height difference set by the height difference setting unit, a transport capacity of refrigerant to be transported from the outdoor unit to the indoor unit. The design information storage unit stores design information about a building on or in which the outdoor unit and the indoor unit are installed. The outdoor unit height information obtaining unit and the indoor unit height information obtaining unit obtain the outdoor unit height information and the indoor unit height information, respectively, on the basis of the design information. In this height difference setting system, the design information storage unit, the outdoor unit height information obtaining unit, and the indoor unit height information obtaining unit are located in the management apparatus. The height difference setting unit and the transport capacity adjusting unit are located in the outdoor unit.

The height difference setting system according to the seventh aspect is capable of setting the height difference between the outdoor unit and the indoor unit on the basis of the design information about the building. Accordingly, the height difference setting system is capable of setting the height difference between the outdoor unit and the indoor unit on the basis of the outdoor unit height information and the indoor unit height information, and is thus capable of making the transport capacity of refrigerant appropriate on the basis of the height difference.

According to a height difference setting system according to an eighth aspect of the present invention, in the height difference setting system according to the seventh aspect, the design information storage unit stores, as the design information, second identification information that is set in advance for the outdoor unit and the indoor unit. The outdoor unit height information obtaining unit and the indoor unit height information obtaining unit obtain, from the design information, the second identification information that is set in advance for the outdoor unit and the indoor unit, and outdoor unit height information and indoor unit height information that are associated with the second identification information. The height difference setting system further includes an identification information setting unit and an identification information converting unit. The identification information setting unit sets first identification information for each of the outdoor unit and the indoor unit at a time of installing the outdoor unit and the indoor unit on or in the building. The identification information converting unit converts the second identification information into the first identification information and obtains outdoor unit height information and indoor unit height information that are associated with the first identification information. In this height difference setting system, the identification information setting unit is located in a setting apparatus connected to the outdoor unit and the management apparatus. The identification information converting unit is located in the management apparatus.

The height difference setting system according to the eighth aspect converts the second identification information that is set in advance on the basis of the design information about the building into the first identification information set by an on-site worker or the like, and is thus capable of setting the transport capacity of refrigerant in an appropriate state even when the second identification information is not identical to the first identification information.

According to a height difference setting system according to a ninth aspect of the present invention, in the height difference setting system according to the first aspect to the eighth aspect, the height difference setting system further includes a monitoring unit and a resetting unit. The monitoring unit monitors an operation condition of the indoor unit. The resetting unit resets the height difference between the outdoor unit and the indoor unit on the basis of the operation condition. The transport capacity adjusting unit adjusts, on the basis of the height difference reset by the resetting unit, the transport capacity of the refrigerant to be transported from the outdoor unit to the indoor unit.

The height difference setting system according to the ninth aspect resets the height difference in accordance with the operation condition of the indoor unit, and is thus capable of optimizing the transport capacity of refrigerant in accordance with the operation condition of the indoor unit.

A communication terminal program according to a tenth aspect of the present invention is a program for operating the communication terminal used in the height difference setting system according to the second aspect to the fourth aspect. This communication terminal program causes a computer of the communication terminal to function as a communication unit that communicates with the outdoor unit and the indoor unit, the outdoor unit height information obtaining unit, and the indoor unit height information obtaining unit.

The communication terminal program according to the tenth aspect is capable of, when being installed in the communication terminal, providing the communication terminal capable of obtaining the outdoor unit height information and the indoor unit height information.

A communication terminal program according to an eleventh aspect of the present invention is a program for operating the communication terminal used in the height difference setting system according to the fifth aspect or the sixth aspect. This communication terminal program causes a computer of the communication terminal to function as a communication unit that communicates with the management apparatus, the outdoor unit height information obtaining unit, and the indoor unit height information obtaining unit.

The communication terminal program according to the eleventh aspect is capable of, when being installed in the communication terminal, providing the communication terminal capable of obtaining the outdoor unit height information and the indoor unit height information and transmitting these pieces of information to the management apparatus.

Advantageous Effects of Invention

The height difference setting system according to the first aspect is capable of setting the transport capacity of refrigerant in an appropriate state.

The height difference setting system according to the second aspect is capable of setting the transport capacity of refrigerant in an appropriate state.

The height difference setting system according to the third aspect is capable of obtaining the outdoor unit height information and the indoor unit height information by using the communication terminal.

The height difference setting system according to the fourth aspect is capable of obtaining the indoor unit height information via the remote controller.

The height difference setting system according to the fifth aspect is capable of obtaining the outdoor unit height information and the indoor unit height information by using the management apparatus and the communication terminal.

The height difference setting system according to the sixth aspect is capable of easily obtaining the indoor unit height information.

The height difference setting system according to the seventh aspect is capable of setting the height difference between the outdoor unit and the indoor unit on the basis of the design information about the building.

The height difference setting system according to the eighth aspect is capable of setting the transport capacity of refrigerant in an appropriate state.

The height difference setting system according to the ninth aspect is capable of optimizing the transport capacity of refrigerant in accordance with the operation condition of the indoor unit.

The communication terminal program according to the tenth aspect is capable of providing the communication terminal capable of obtaining the outdoor unit height information and the indoor unit height information.

The communication terminal program according to the eleventh aspect is capable of providing the communication terminal capable of obtaining the outdoor unit height information and the indoor unit height information and transmitting these pieces of information to the management apparatus.

BRIEF DESCRIPTION OF THE DRAWINGS

FIG. 13 is a schematic diagram illustrating a configuration of association between identification information and information including indoor unit height information and outdoor unit height information according to the modification 2D.

FIG. 16 is a schematic diagram illustrating a configuration of design information L according to the third embodiment.

FIG. 19 is a schematic diagram illustrating a configuration of a storage unit 43C according to the modification 3A.

DESCRIPTION OF EMBODIMENTS

Concept of Present Invention

Figure 1:
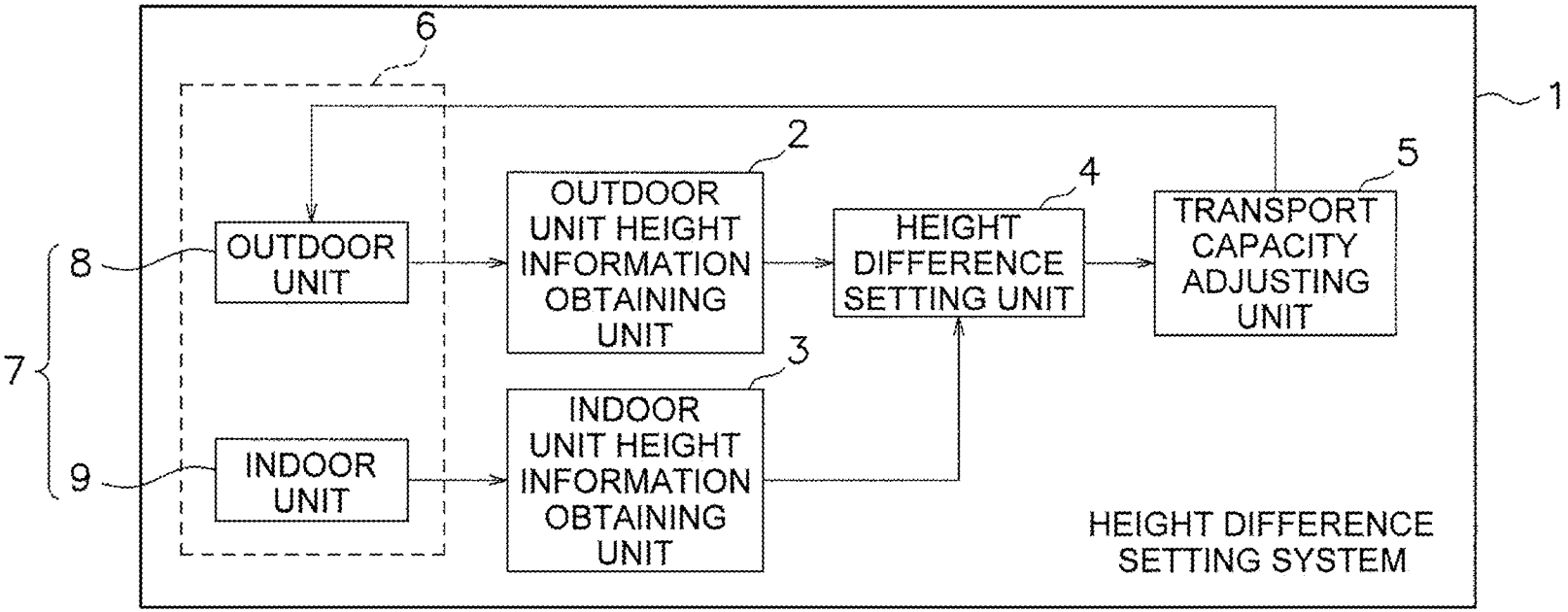
FIG. 1 is a schematic diagram illustrating a concept of a height difference setting system 1 according to the present invention.

FIG. 1 is a schematic diagram illustrating a concept of a height difference setting system 1 according to the present invention. The height difference setting system 1 according to the present invention is constituted by a plurality of components. Information is communicated between the components, and accordingly information about a height difference between an outdoor unit 8 and an indoor unit 9 that constitute an air conditioner 7 installed on or in a building 6 is set. The air conditioner 7 includes the outdoor unit 8 and one or more indoor units 9 associated with the outdoor unit 8.

Specifically, the height difference setting system 1 includes components that function as an outdoor unit height information obtaining unit 2, an indoor unit height information obtaining unit 3, a height difference setting unit 4, and a transport capacity adjusting unit 5.

The outdoor unit height information obtaining unit 2 obtains outdoor unit height information indicating a height of an installation place of the outdoor unit 8. The outdoor unit height information obtaining unit 2 transmits the obtained outdoor unit height information to the height difference setting unit 4.

The indoor unit height information obtaining unit 3 obtains indoor unit height information indicating a height of an installation place of the indoor unit. The indoor unit height information obtaining unit 3 transmits the obtained indoor unit height information to the height difference setting unit 4.

The height difference setting unit 4 sets a height difference between the outdoor unit 8 and the indoor unit 9 on the basis of the outdoor unit height information and the indoor unit height information. The height difference setting unit 4 transmits the set height difference to the transport capacity adjusting unit 5.

The transport capacity adjusting unit 5 adjusts, on the basis of the height difference set by the height difference setting unit, a transport capacity of refrigerant to be transported from the outdoor unit 8 to the indoor unit 9.

The above-described components are located in a distributed manner, thereby implementing the function as the height difference setting system 1 according to the present invention.

Hereinafter, a plurality of embodiments according to the present invention will be described with reference to the drawings. In the following description, an item that has already been described will be denoted by substantially the same reference numeral, and a duplicate description may be omitted. In each embodiment, a description may be given with upper-case alphabetic letters A to D attached to reference numerals in distinction from other embodiments or the like.

The drawings used in the following description may illustrate a component of another embodiment with a broken line, in addition to a component of the present embodiment. In this case, a part represented by a solid line is a part that is related to the present embodiment, and a part represented by a broken line is a part that is not necessarily related to the present embodiment. In short, a part represented by a broken line is merely illustrated for convenience to facilitate understanding.

First Embodiment

(1-1) Configuration of Height Difference Setting System 1A

Figure 2:
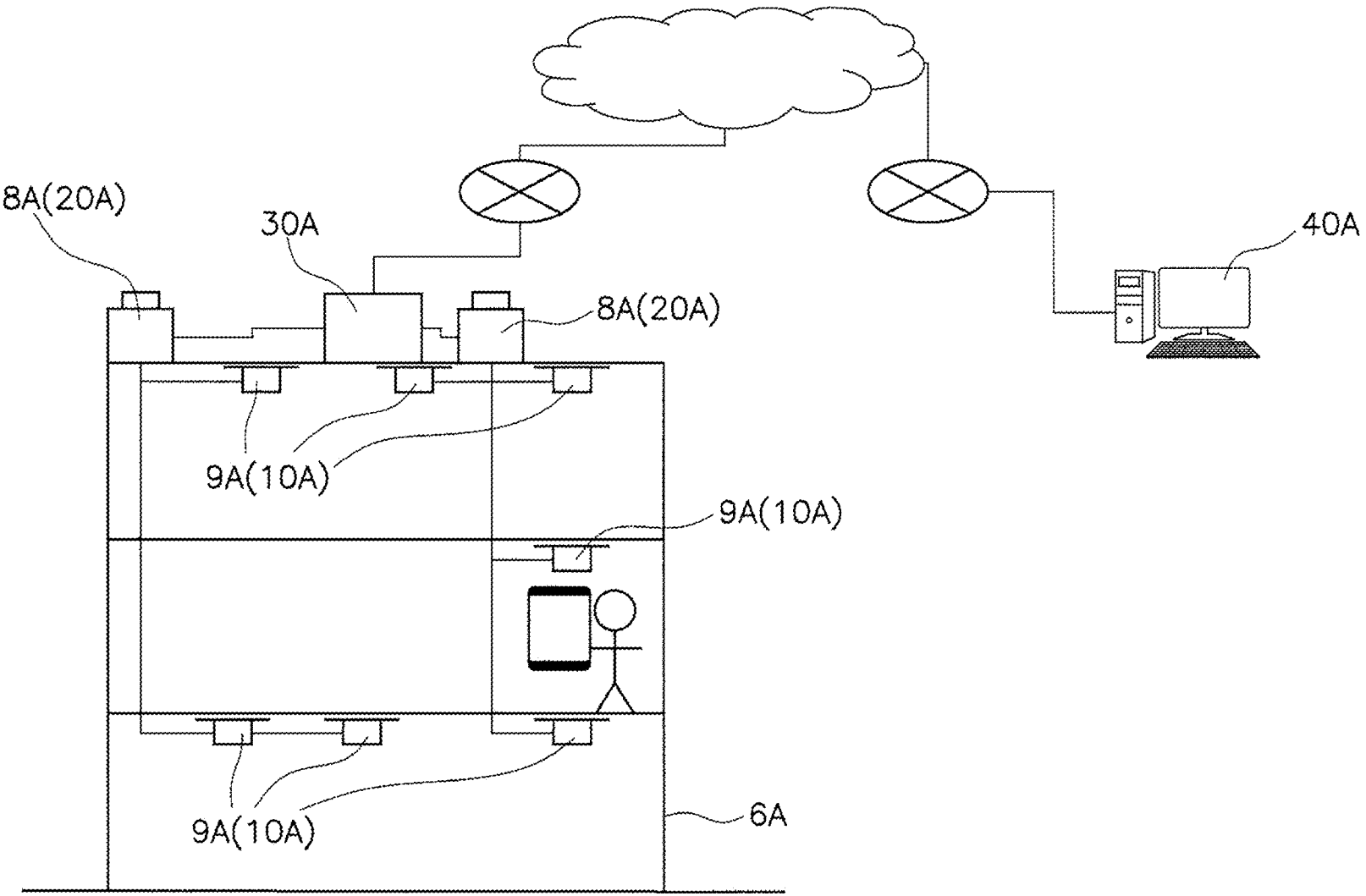
FIG. 2 is a schematic diagram illustrating a concept of a height difference setting system 1A according to a first embodiment of the present invention.
Figure 3:
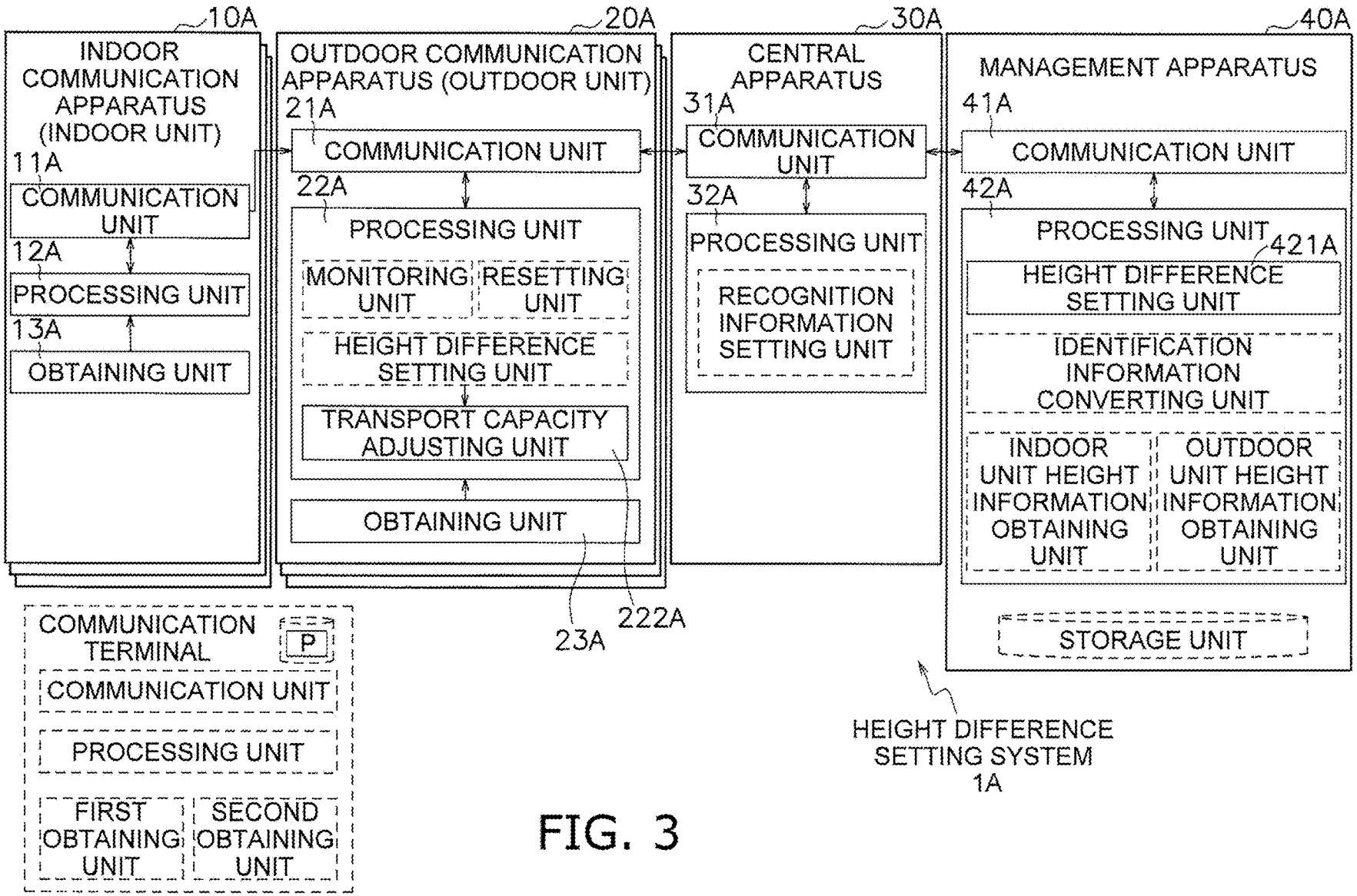
FIG. 3 is a schematic diagram illustrating a configuration of the height difference setting system 1A according to the first embodiment.

FIG. 2 is a schematic diagram illustrating a concept of a height difference setting system 1A according to a first embodiment of the present invention. FIG. 3 is a schematic diagram illustrating a configuration of the height difference setting system 1A according to the first embodiment.

The height difference setting system 1A according to this embodiment includes a management apparatus 40A. In the height difference setting system 1A according to this embodiment, the outdoor unit height information obtaining unit 2 and the transport capacity adjusting unit 5 are located in an outdoor unit 8A. The indoor unit height information obtaining unit 3 is located in an indoor unit 9A. The height difference setting unit 4 is located in the management apparatus 40A.

Hereinafter, the configuration of the height difference setting system 1A according to this embodiment will be described in more detail. The height difference setting system 1A according to this embodiment includes an indoor communication apparatus 10A, an outdoor communication apparatus 20A, a central apparatus 30A, and the management apparatus 40A.

The indoor communication apparatus 10A is an apparatus housed in the indoor unit 9A and includes a communication unit 11A, a processing unit 12A, and an obtaining unit 13A (corresponding to the indoor unit height information obtaining unit 3). The indoor communication apparatus 10A also includes a storage unit that stores various pieces of information and that is not illustrated.

The communication unit 11A communicates with the outdoor communication apparatus 20A. The communication unit 11A is capable of communicating not only with the outdoor communication apparatus 20A but also with the central apparatus 30A and the management apparatus 40A.

The processing unit 12A performs various information processing operations in the indoor communication apparatus 10A and transmits information obtained from the indoor unit 9A to the outdoor communication apparatus 20A and so forth.

The obtaining unit 13A obtains "indoor unit height information" indicating the height of the installation place of the indoor unit 9A. The obtaining unit 13A is constituted by a height sensor, such as an atmospheric pressure sensor, a geomagnetic sensor, or a GPS sensor.

The outdoor communication apparatus 20A is an apparatus housed in the outdoor unit 8A and includes a communication unit 21A, a processing unit 22A, and an obtaining unit 23A (corresponding to the outdoor unit height information obtaining unit 2). The outdoor communication apparatus 20A also includes a storage unit that stores various pieces of information and that is not illustrated.

The communication unit 21A communicates with the indoor communication apparatus 10 and the central apparatus 30A. The communication unit 21A is capable of communicating with the management apparatus 40A without via the central apparatus 30.

The processing unit 22A performs various information processing operations in the outdoor communication apparatus 20 and transmits information obtained from the indoor communication apparatus 10A to the management apparatus 40A and so forth via the central apparatus 30A. The processing unit 22A has a function as a transport capacity adjusting unit 222A (corresponding to the transport capacity adjusting unit 5) and adjusts the transport capacity of refrigerant to be transported from the outdoor unit 8A to the indoor unit 9A on the basis of a height difference set by a height difference setting unit 421A (corresponding to the height difference setting unit 4) of the management apparatus 40A, which will be described below.

The obtaining unit 23A obtains "outdoor unit height information" indicating the height of the installation place of the outdoor unit 8A. The obtaining unit 23A is constituted by a height sensor, such as an atmospheric pressure sensor, a geomagnetic sensor, or a GPS sensor.

The central apparatus 30A includes a communication unit 31A and a processing unit 32A and relays communication among the indoor communication apparatus 10A, the outdoor communication apparatus 20A, and the management apparatus 40A. Here, the communication unit 31A communicates with the outdoor communication apparatus 20A or the management apparatus 40A, but the communication unit 31A is also capable of communicating with the indoor communication apparatus 10A. The central apparatus 30A also includes a storage unit that stores various pieces of information and that is not illustrated. The central apparatus 30A is capable of setting communication addresses for the outdoor unit 8A and the indoor unit 9A.

The management apparatus 40A manages many air conditioners 7A through a network and includes a communication unit 41A and a processing unit 42A. The management apparatus 40A also includes a storage unit that stores various pieces of information and that is not illustrated.

The communication unit 41A communicates with the central apparatus 30A. The communication unit 41A is also capable of communicating with the indoor communication apparatus 10A and/or the outdoor communication apparatus 20A without via the central apparatus 30A. The management apparatus 40A obtains indoor unit height information and outdoor unit height information by using the communication unit 41A.

The processing unit 42A performs various information processing operations of the management apparatus 40A and has a function as the height difference setting unit 421A (corresponding to the height difference setting unit 4). With use of the function of the height difference setting unit 421A, the processing unit 42A sets a height difference between the outdoor unit 8A and the indoor unit 9A on the basis of the indoor unit height information obtained from the indoor communication apparatus 10A and the outdoor unit height information obtained from the outdoor communication apparatus 20A. At this time, when a plurality of indoor units 9A are associated with the outdoor unit 8A, the processing unit 42A sets a height difference between the outdoor unit 8A and the indoor unit 9A that has the largest height difference from the outdoor unit 8A. The processing unit 42A then transmits information about the height difference between the outdoor unit 8A and the indoor unit 9A to the outdoor communication apparatus 20A via the communication unit 41A.

(1-2) Height Difference Setting by Height Difference Setting System 1A

Figure 4:
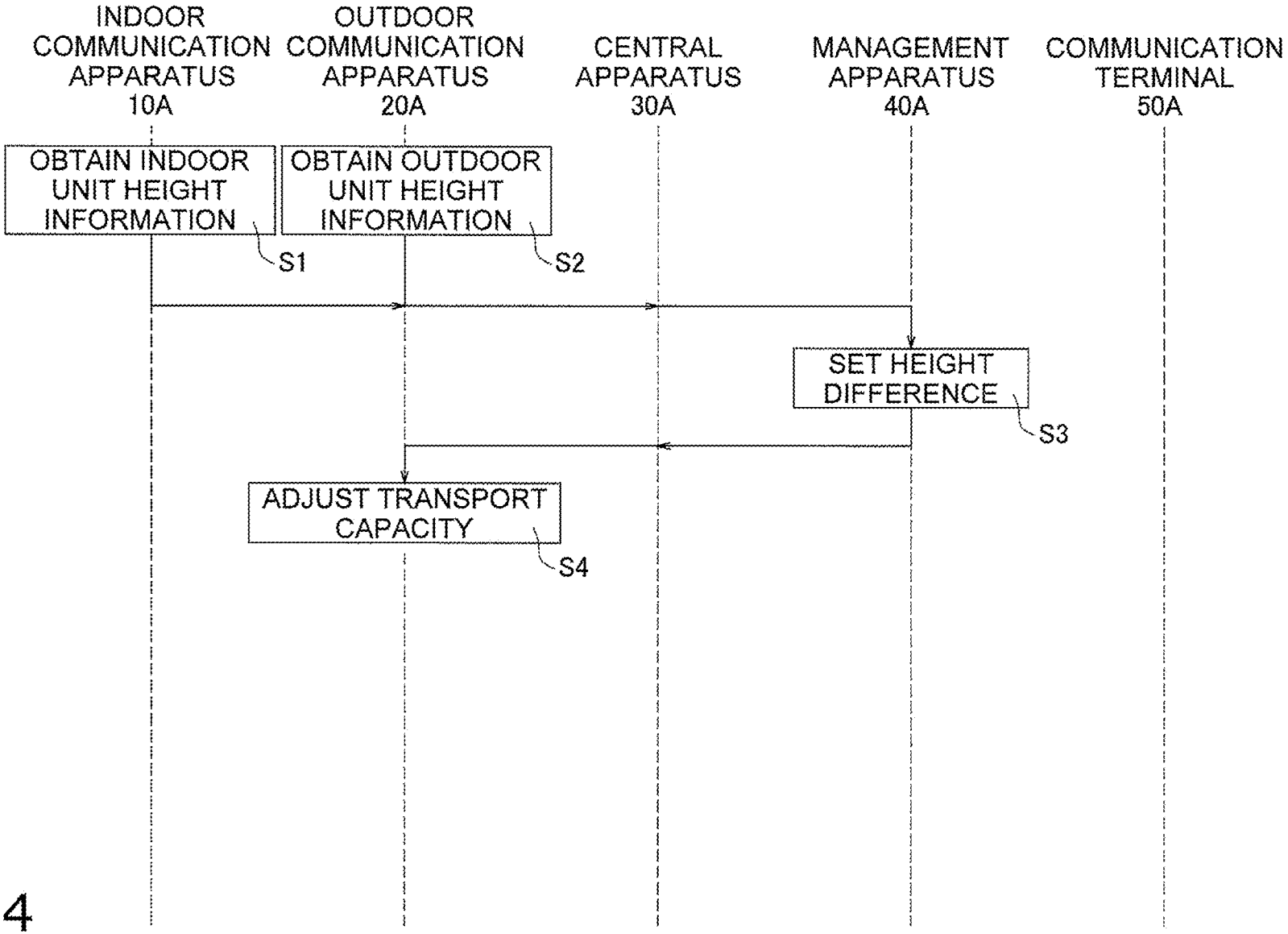
FIG. 4 is a sequence diagram illustrating an operation of height setting in the height difference setting system 1A according to the first embodiment.

Height difference setting in the height difference setting system 1A according to this embodiment will be described with reference to the sequence diagram illustrated in FIG. 4.

First, the outdoor unit 8A and the indoor units 9A are installed at predetermined positions of a building 6A by an on-site worker or the like. Subsequently, a test operation of the outdoor unit 8A and the indoor units 9A is performed. In the test operation, the indoor units 9A are operated one by one, and it is determined whether or not the corresponding outdoor unit 8A normally operates, whether or not cool air and warm air come out, whether or not a wind direction control button and an air volume control button function, and so forth.

In the test operation, the indoor communication apparatus 10A and the outdoor communication apparatus 20A respectively housed in each indoor unit 9A and the outdoor unit 8A are activated. Subsequently, the obtaining unit 13A of the indoor communication apparatus 10A and the obtaining unit 23A of the outdoor communication apparatus 20A respectively obtain indoor unit height information and outdoor unit height information (S1, S2). Here, upon obtaining the indoor unit height information, the indoor communication apparatus 10 transmits the indoor unit height information to the outdoor communication apparatus 20. Subsequently, the outdoor communication apparatus 20 transmits the indoor unit height information and the outdoor unit height information to the management apparatus 40A via the central apparatus 30.

In the management apparatus 40A, the processing unit 42A calculates, with use of the function of the height difference setting unit 421A, height difference information indicating the height difference between the outdoor unit 8 and the indoor unit 9 on the basis of the indoor unit height information and the outdoor unit height information (S3). Here, when a plurality of indoor units 9A are associated with the outdoor unit 8A, the processing unit 42A calculates height difference information between the outdoor unit 8A and the indoor unit 9A that has the largest height difference from the outdoor unit 8A. Subsequently, the management apparatus 40A transmits the height difference information to the outdoor communication apparatus 20A via the central apparatus 30A.

Upon receiving the height difference information, the outdoor communication apparatus 20A sets, in accordance with the height difference information, a transport capacity of refrigerant to be transported from the outdoor unit 8A to the indoor unit 9A (S4). The outdoor communication apparatus 20A stores in advance, in a memory or the like, correspondence information indicating the correspondence between height difference information and adjustment amounts of transport capacity, and sets the transport capacity on the basis of the correspondence information.

In the description given above, step S1 is described before step S2 for convenience, but step S2 may be performed before step S1. In short, the order of the above-described steps S1 and S2 is not specified.

(1-3) Characteristics

As described above, in the height difference setting system 1A according to the first embodiment, the height difference between the outdoor unit 8A and one or more indoor units 9A associated with the outdoor unit 8A is set by the management apparatus 40A that communicates with either or both of the outdoor unit 8 and each of the one or more indoor units 9.

The obtaining unit 13A (indoor unit height information obtaining unit) of the indoor communication apparatus 10A obtains "indoor unit height information" indicating the height of the installation place of the indoor unit 9A. The obtaining unit 23A (outdoor unit height information obtaining unit) of the outdoor communication apparatus 20A obtains "outdoor unit height information" indicating the height of the installation place of the outdoor unit 8A. Subsequently, the height difference setting unit 421A of the management apparatus 40A calculates and sets height difference information about the outdoor unit 8A and the indoor unit 9A on the basis of the outdoor unit height information and the indoor unit height information. Subsequently, the transport capacity adjusting unit 222A of the outdoor communication apparatus 20A adjusts the transport capacity of refrigerant to be transported from the outdoor unit 8A to the indoor unit 9A on the basis of the height difference set by the height difference setting unit 421A of the management apparatus 40A.

Thus, the height difference setting system 1A according to this embodiment is capable of setting, with use of the management apparatus 40A, the height difference between the outdoor unit 8A and the indoor unit 9A on the basis of the outdoor unit height information and the indoor unit height information. In addition, the height difference setting system 1A according to this embodiment adjusts the transport capacity of refrigerant on the basis of the height difference and is thus capable of setting the transport capacity of refrigerant in an appropriate state.

In addition, it is a compressor that most consumes electric power in the outdoor unit 8A. The amount of work necessary for the compressor, that is, the transport capacity for allowing refrigerant to go around largely depends on the installation places of the outdoor unit 8A and the indoor unit 9A. This is because it is necessary to resist gravity to transport refrigerant from a low place to a high place. A larger transport capacity is required to transport the refrigerant from the low place to the high place. Under such assumption, in the height difference setting system 1A according to this embodiment, the transport capacity of refrigerant is adjusted in an appropriate state, which makes it is possible to avoid an increase in power consumption caused by setting of an excessive transport capacity. Also, in the height difference setting system 1A according to this embodiment, an inappropriate cooling operation or heating operation caused by an insufficient transport capacity can be avoided.

Furthermore, in the height difference setting system 1A according to this embodiment, the obtaining unit 13A of the indoor communication apparatus 10A and the obtaining unit 23A of the outdoor communication apparatus 20A are capable of automatically obtaining indoor unit height information and outdoor unit height information, respectively, at the time of installing the outdoor unit 8A and the indoor unit 9A on or in the building 6A. Accordingly, the height difference setting system 1A has effects (i) a man-hour for input to set a height difference can be reduced, (ii) input mistakes can be eliminated when an on-site worker sets a height difference, and (iii) a situation can be prevented from occurring where a height difference is not set by an on-site worker.

(1-4) Modifications

(1-4-1) Modification 1A

In the description given above, the indoor communication apparatus 10A transmits indoor unit height information to the management apparatus 40A via the outdoor communication apparatus 20A and the central apparatus 30A, but the indoor communication apparatus 10A may communicate with the management apparatus 40A via the central apparatus 30A without via the outdoor communication apparatus 20A. Furthermore, the indoor communication apparatus 10A may directly communicate with the management apparatus 40A.

(1-4-2) Modification 1B

In the height difference setting system 1A according to this embodiment, a height difference is set on the basis of the height information about the outdoor unit 8A and the indoor unit 9A, but a height difference may be set by reflecting information other than heights. For example, depending on the types of sensors of the obtaining unit 13A of the indoor communication apparatus 10 and the obtaining unit 23A of the outdoor communication apparatus 20, information indicating a distance in the horizontal direction or the like can be obtained other than the height difference. The height difference setting system 1A may set a height difference by taking such information into account.

Second Embodiment

(2-1) Configuration of Height Difference Setting System 1B

Figure 5:
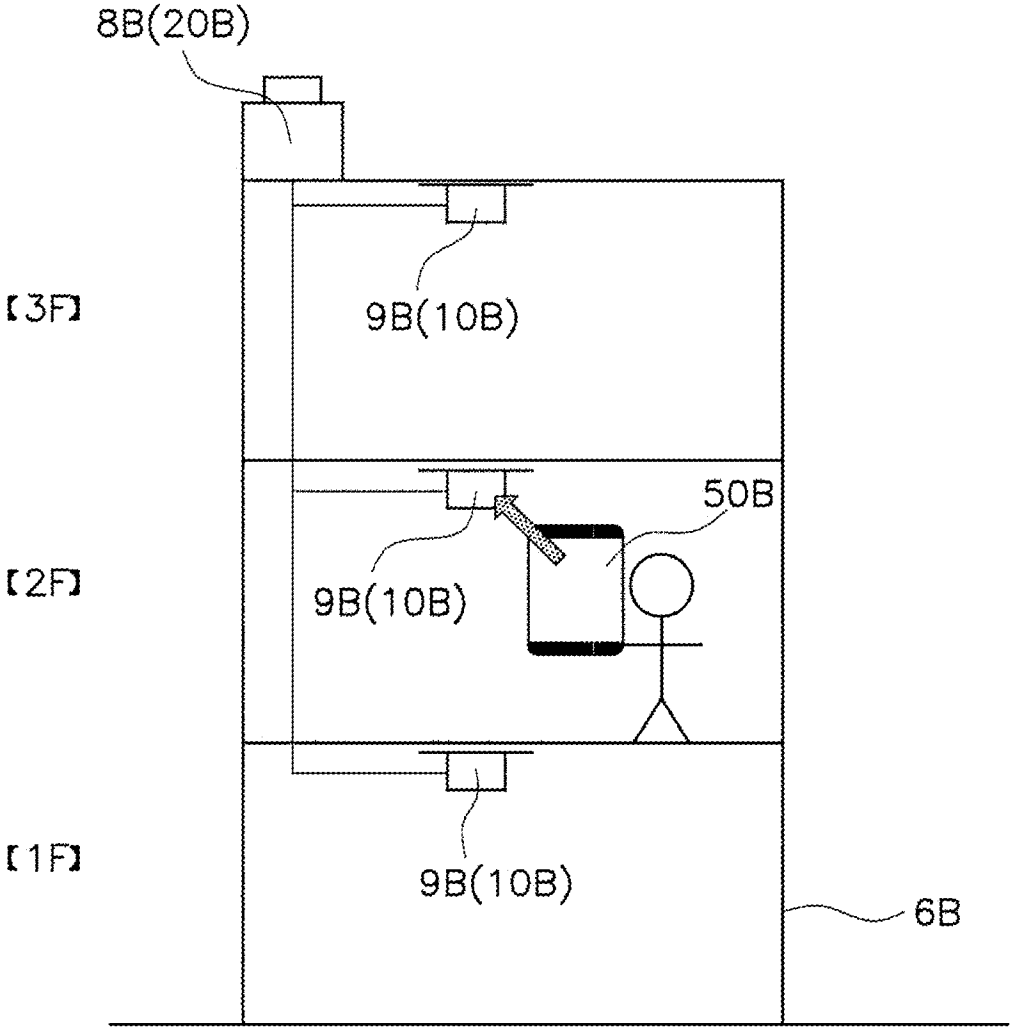
FIG. 5 is a schematic diagram illustrating a concept of a height difference setting system 1B according to a second embodiment of the present invention.
Figure 6:
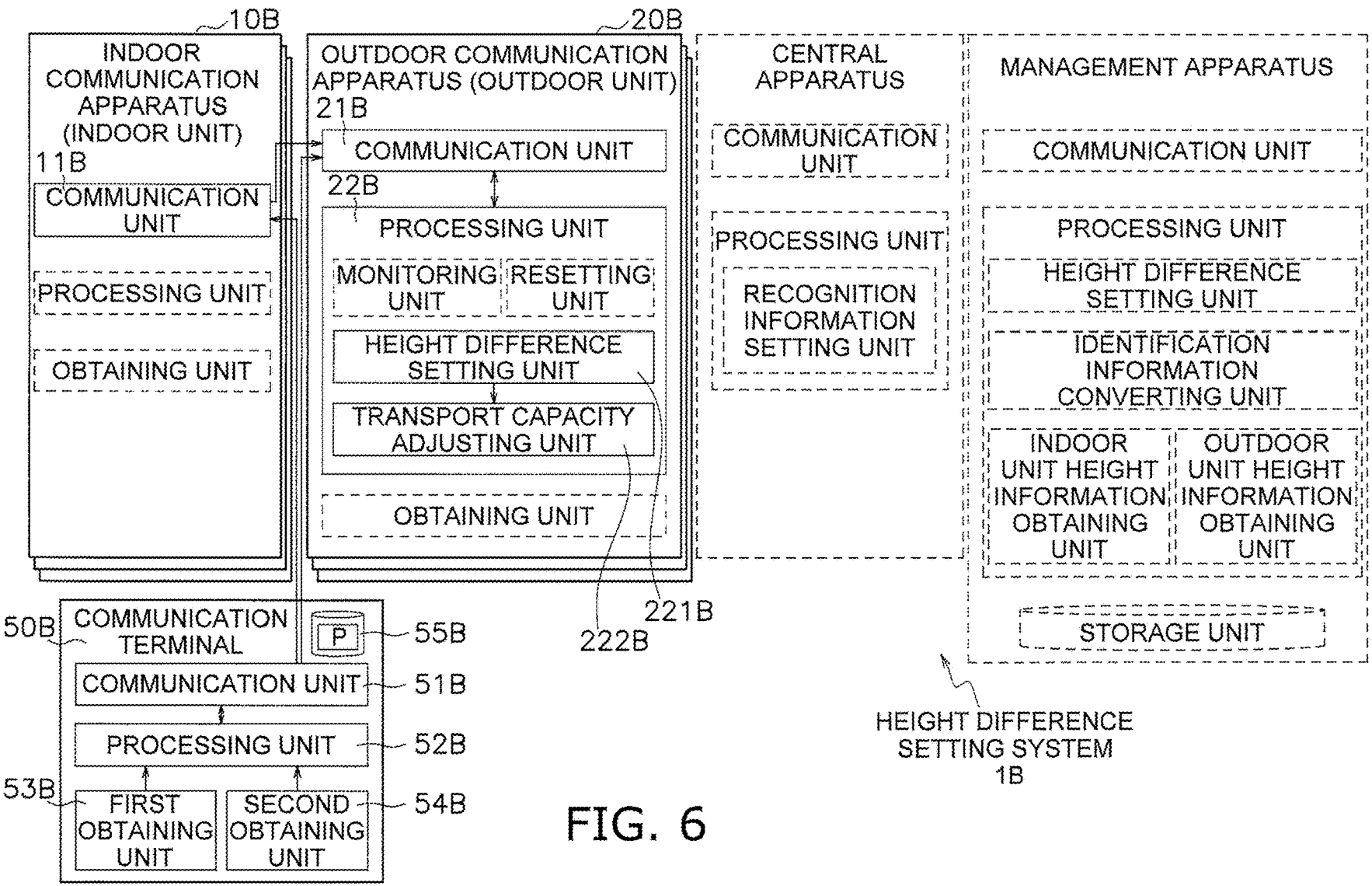
FIG. 6 is a schematic diagram illustrating a configuration of the height difference setting system 1B according to the second embodiment.

FIG. 5 is a schematic diagram illustrating a concept of a height difference setting system 1B according to a second embodiment of the present invention. FIG. 6 is a schematic diagram illustrating a configuration of the height difference setting system 1B according to the second embodiment.

The height difference setting system 1B according to this embodiment includes a communication terminal 50B. In the height difference setting system 1B according to this embodiment, the outdoor unit height information obtaining unit 2 and the indoor unit height information obtaining unit 3 are located in the communication terminal 50B. The height difference setting unit 4 is located in an outdoor unit 8B.

Hereinafter, the configuration of the height difference setting system 1B according to this embodiment will be described in more detail. The height difference setting system 1B according to this embodiment includes an indoor communication apparatus 10B, an outdoor communication apparatus 20B, and the communication terminal 50B.

The indoor communication apparatus 10B is an apparatus housed in an indoor unit 9B and includes a communication unit 11B. The communication unit 11B communicates with the outdoor communication apparatus 20B and the communication terminal 50B. The indoor communication apparatus 10B also includes a storage unit that stores various pieces of information and that is not illustrated.

The outdoor communication apparatus 20B is an apparatus housed in the outdoor unit 8B and includes a communication unit 21B and a processing unit 22B. The communication unit 21B communicates with the indoor communication apparatus 10B and the communication terminal 50B. The processing unit 22B performs various information processing operations in the outdoor communication apparatus 20B and has functions as a height difference setting unit 221B (corresponding to the height difference setting unit 4) and a transport capacity adjusting unit 222B (corresponding to the transport capacity adjusting unit 5). That is, the processing unit 22B sets a height difference between the outdoor unit 8B and the indoor unit 9B on the basis of the outdoor unit height information and indoor unit height information obtained by the communication terminal 50B, which will be described below, and adjusts the transport capacity of refrigerant to be transported from the outdoor unit 8B to the indoor unit 9B. The outdoor communication apparatus 20B also includes a storage unit that stores various pieces of information and that is not illustrated.

The communication terminal 50B is a portable apparatus used for setting a height difference between the outdoor unit 8B and the indoor unit 9B. The communication terminal 50B includes a communication unit 51B, a processing unit 52B, a first obtaining unit 53B (corresponding to the outdoor unit height information obtaining unit 2), and a second obtaining unit 54B (corresponding to the indoor unit height information obtaining unit 3). The individual functions of the communication terminal 50B can be implemented by installing a "communication terminal program P" in a general smart device. The communication terminal 50B may have a program, such as an assistance tool for assisting a test operation of the air conditioner 7A. Such an assistance tool is used by an on-site worker when checking refrigerant leakage of the outdoor unit 8B, checking an intake temperature of the indoor unit 9B, and the like.

The communication unit 51B communicates with the indoor communication apparatus 10B and the outdoor communication apparatus 20B. The information obtained by the communication terminal 50B is transmitted to the indoor communication apparatus 10B and the outdoor communication apparatus 20B by using the communication unit 51B.

The processing unit 52B performs various information processing operations in the communication terminal 50B.

The first obtaining unit 53B obtains "outdoor unit height information" indicating the height of the installation place of the outdoor unit 8B. The first obtaining unit 53B is constituted by a height sensor, such as a GPS sensor, a geomagnetic sensor, or an atmospheric pressure sensor.

The second obtaining unit 54B obtains "indoor unit height information" indicating the height of the installation place of the indoor unit 9B. The second obtaining unit 54B is constituted by a height sensor, such as a GPS sensor, a geomagnetic sensor, or an atmospheric pressure sensor.

The communication terminal 50B includes a storage unit 55B that stores various pieces of information. The storage unit 55B stores the communication terminal program P.

(2-2) Height Difference Setting in Height Difference Setting System 1B

Figure 7:
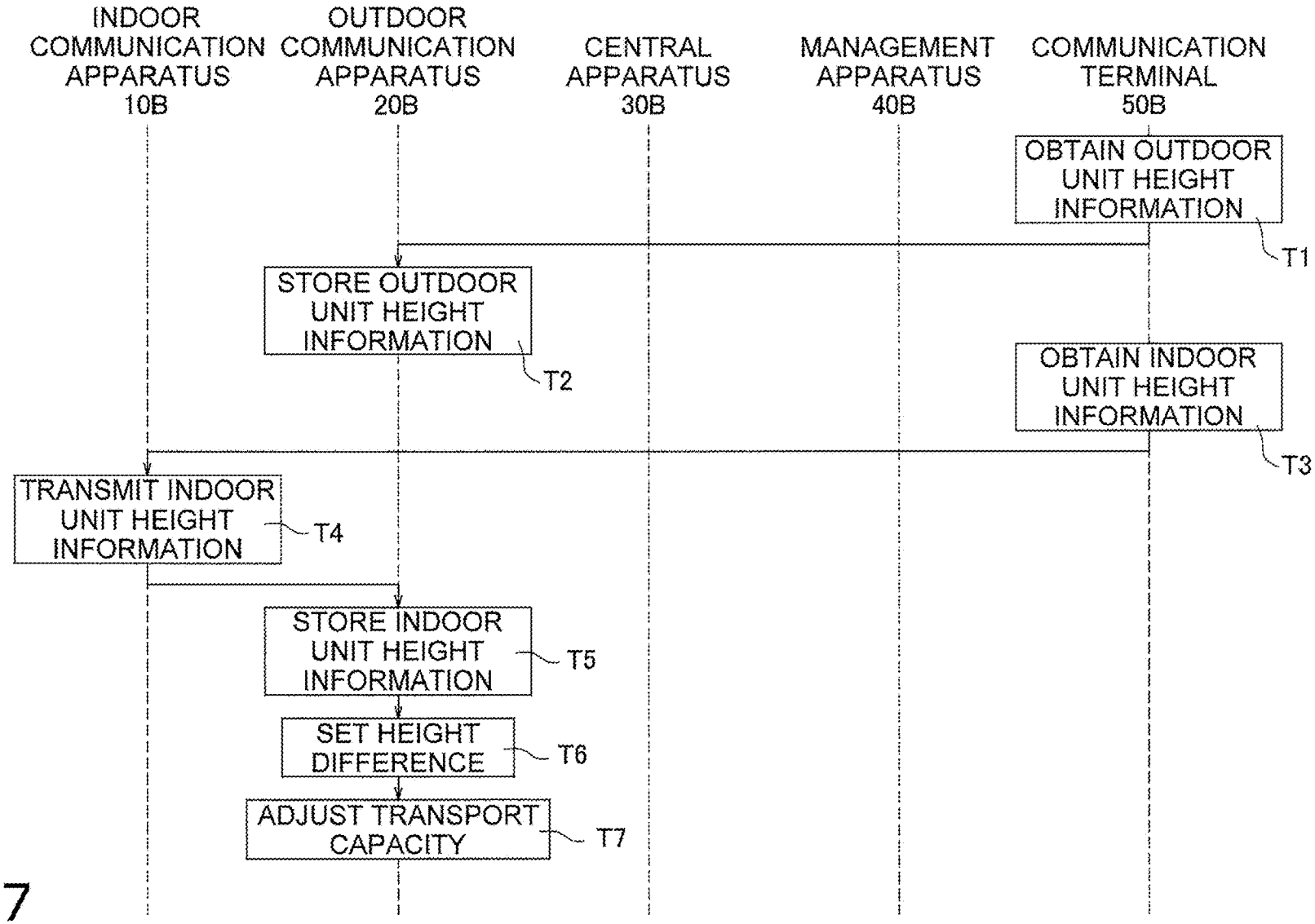
FIG. 7 is a sequence diagram illustrating an operation of height difference setting in the height difference setting system 1B according to the second embodiment.

Height difference setting in the height difference setting system 1B according to this embodiment will be described with reference to the sequence diagram illustrated in FIG. 7.

First, the outdoor unit 8B and the indoor units 9B are installed at predetermined positions of a building 6B by an on-site worker or the like. Subsequently, a test operation of the outdoor unit 8B and the indoor units 9B is performed. In the test operation, the indoor units 9B are operated one by one, and it is determined whether or not the corresponding outdoor unit 8B normally operates, whether or not cool air and warm air come out, whether or not a wind direction control button and an air volume control button function, and so forth.

In the test operation, the on-site worker or the like obtains outdoor unit height information and indoor unit height information by using the communication terminal 50B.

Specifically, when the on-site worker or the like installs the outdoor unit 8B, the communication terminal 50B obtains outdoor unit height information by using the function of the first obtaining unit 53B and transmits the obtained outdoor unit height information to the outdoor communication apparatus 20B (T1). The outdoor communication apparatus 20B receives and stores the outdoor height information (T2).

When the on-site worker or the like installs the indoor unit 9B, the communication terminal 50B obtains indoor unit height information by using the function of the second obtaining unit 54B and transmits the obtained indoor unit height information to the indoor communication apparatus 10B (T3). Upon receiving the indoor unit height information, the indoor communication apparatus 10B transmits the indoor unit height information to the outdoor communication apparatus 20B (T4). Subsequently, the outdoor communication apparatus 20B receives and stores the indoor height information (T5).

Subsequently, in the outdoor communication apparatus 20B, the processing unit 22B calculates, with use of the function of the height difference setting unit 221B, height difference information indicating the height difference between the outdoor unit 8B and the indoor unit 9B on the basis of the indoor unit height information and the outdoor unit height information (T6). Here, when a plurality of indoor units 9B are associated with the outdoor unit 8B, the processing unit 22B calculates height difference information between the outdoor unit 8B and the indoor unit 9B that has the largest height difference from the outdoor unit 8B.

Subsequently, the outdoor communication apparatus 20B sets the transport capacity of refrigerant to be transported from the outdoor unit 8B to the indoor unit 9B in accordance with the calculated height difference information (T7). The outdoor communication apparatus 20B stores in advance, in a memory or the like, correspondence information indicating the correspondence between height difference information and adjustment amounts of transport capacity, and sets the transport capacity on the basis of the correspondence information.

In the description given above, steps T1 and T2 are described before steps T3 and T4 for convenience, but steps T3 and T4 may be performed before steps T1 and T2. In short, the order of the above-described steps T1 and T2 and steps T3 and T4 is not specified.

(2-3) Characteristics

As described above, in the height difference setting system 1B according to the second embodiment, the height difference between the outdoor unit 8B and one or more indoor units 9B associated with the outdoor unit 8B is set by using the predetermined communication terminal 50B that is capable of communicating with the outdoor unit 8B and each of the one or more indoor units 9B.

The first obtaining unit 53B (outdoor unit height information obtaining unit) of the communication terminal 50B obtains "outdoor unit height information" indicating the height of the installation place of the outdoor unit 8B. The second obtaining unit 54B (indoor unit height information obtaining unit) of the communication terminal 50B obtains "indoor unit height information" indicating the height of the installation place of the indoor unit 9B. Subsequently, the height difference setting unit 221B of the outdoor communication apparatus 20B sets the height difference between the outdoor unit 8B and the indoor unit 9B on the basis of the outdoor unit height information and the indoor unit height information. Subsequently, the transport capacity adjusting unit 222B of the outdoor communication apparatus 20B adjusts the transport capacity of refrigerant to be transported from the outdoor unit 8B to the indoor unit 9B on the basis of the height difference set by the height difference setting unit 221B.

In short, the height difference setting system 1B according to this embodiment is capable of obtaining outdoor unit height information and indoor unit height information by using the communication terminal 50B. The height difference setting system 1B according to this embodiment is capable of setting the height difference between the outdoor unit 8B and the indoor unit 9B on the basis of the outdoor unit height information and the indoor unit height information, and is thus capable of setting the transport capacity of refrigerant in an appropriate state on the basis of the height difference. In other words, in the height difference setting system 1B according to this embodiment, the transport capacity of refrigerant is adjusted in an appropriate state, which makes it is possible to avoid an increase in power consumption caused by setting of an excessive transport capacity. Also, in the height difference setting system 1B according to this embodiment, an inappropriate cooling operation or heating operation caused by an insufficient transport capacity can be avoided.

Furthermore, in the height difference setting system 1B according to this embodiment, the first obtaining unit 53B and the second obtaining unit 54B of the communication terminal 50B are capable of automatically obtaining indoor unit height information and outdoor unit height information, respectively, at the time of installing the outdoor unit 8B and the indoor unit 9B on or in the building 6B. Accordingly, the height difference setting system 1B has effects (i) a man-hour for input to set a height difference can be reduced, (ii) input mistakes can be eliminated when an on-site worker sets a height difference, and (iii) a situation can be prevented from occurring where a height difference is not set by an on-site worker.

(2-4) Modifications (2-4-1) Modification 2A

In the description given above, indoor unit height information is transmitted from the communication terminal 50B to the outdoor communication apparatus 20B located in the outdoor unit 8B via the indoor communication apparatus 10B located in the indoor unit 9B, but the height difference setting system 1B according to this embodiment is not limited to this configuration.

Figure 8:
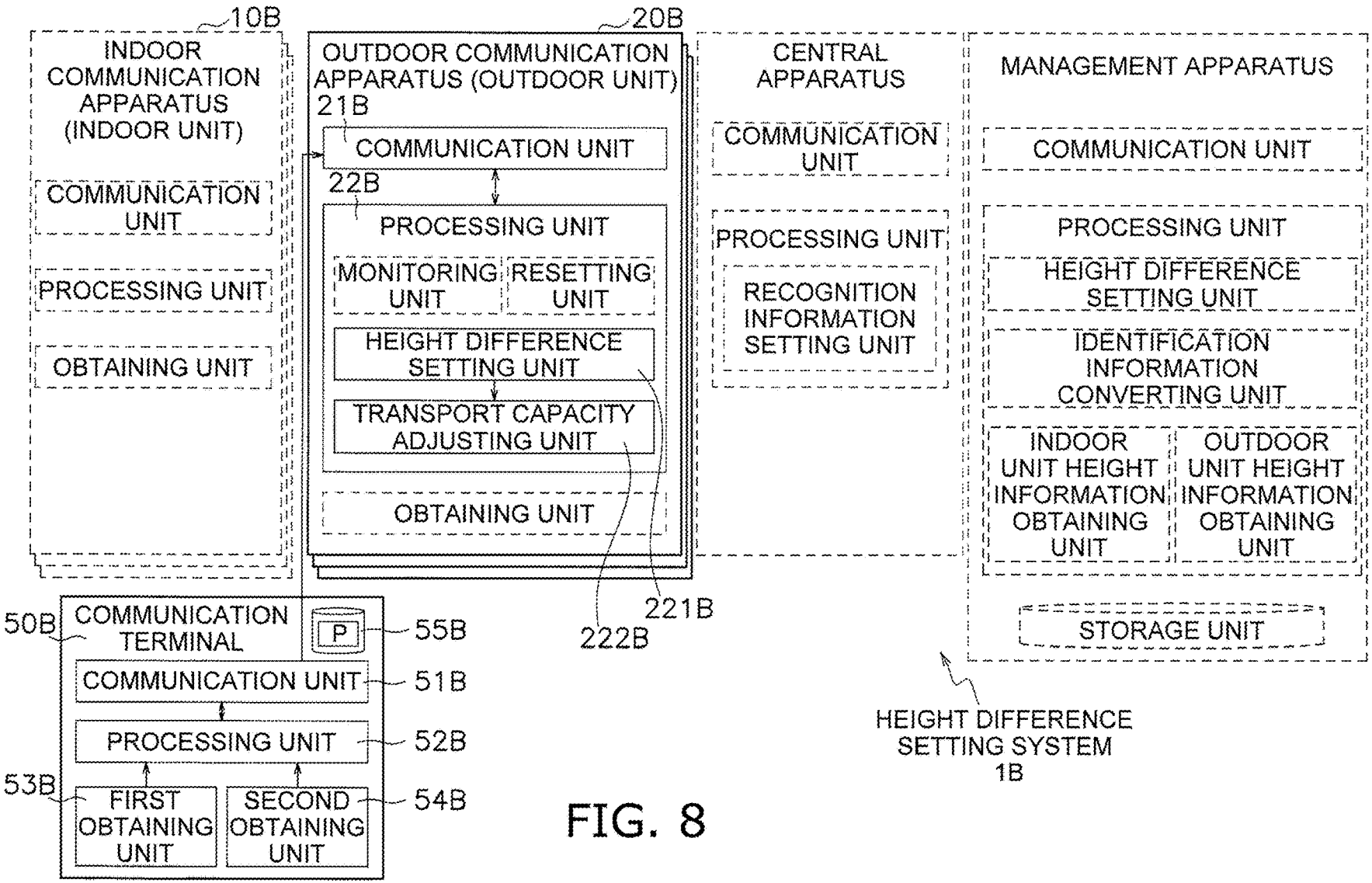
FIG. 8 is a schematic diagram illustrating a configuration of a height difference setting system 1B according to a modification 2A.

For example, the height difference setting system 1B according to this embodiment may have a configuration in which the communication terminal 50B stores indoor unit height information and outdoor unit height information and collectively transmits the indoor unit height information and the outdoor unit height information to the outdoor communication apparatus 20B later. Accordingly, as illustrated in FIG. 8, the communication between the indoor communication apparatus 10B and the communication terminal 50B and the communication between the indoor communication apparatus 10B and the outdoor communication apparatus 20B can be omitted.

(2-4-2) Modification 2B

Figure 9:
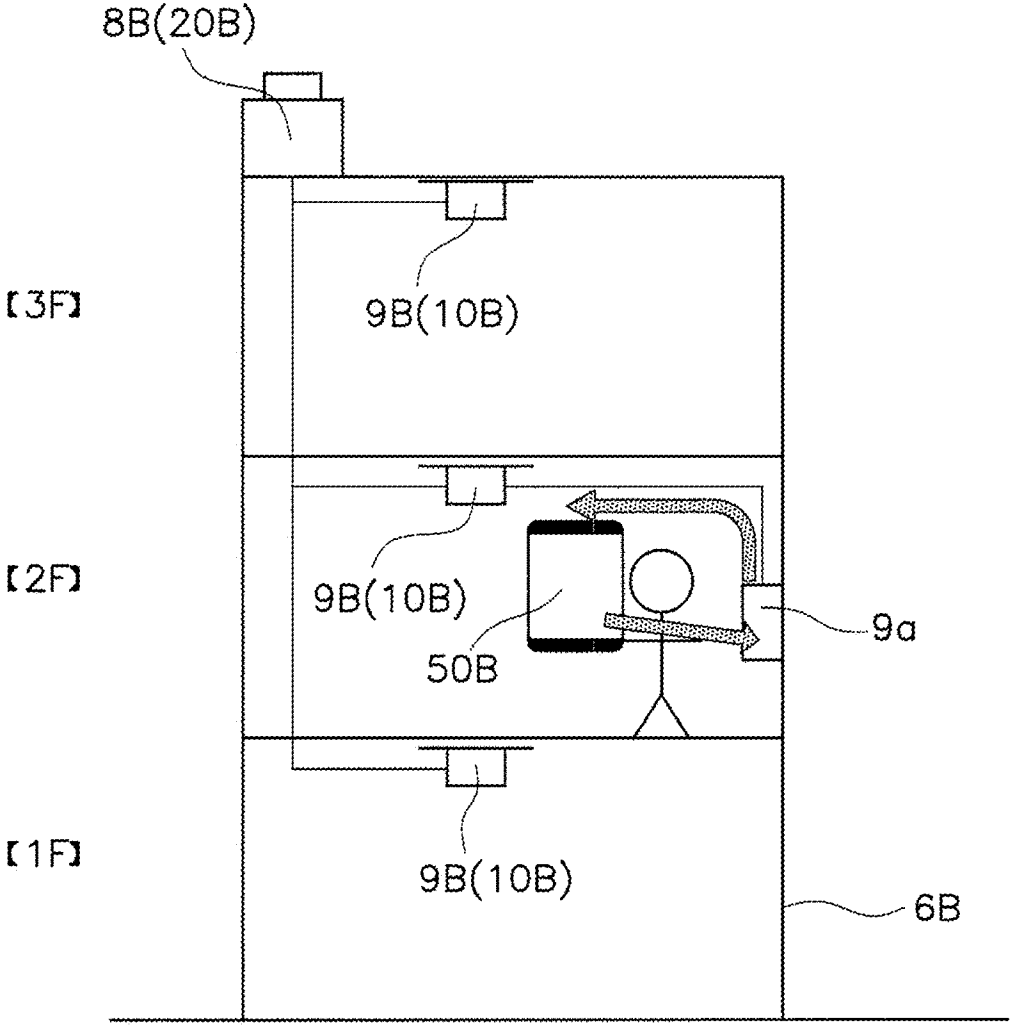
FIG. 9 is a schematic diagram illustrating a concept of a height difference setting system 1B according to a modification 2B.
Figure 10:
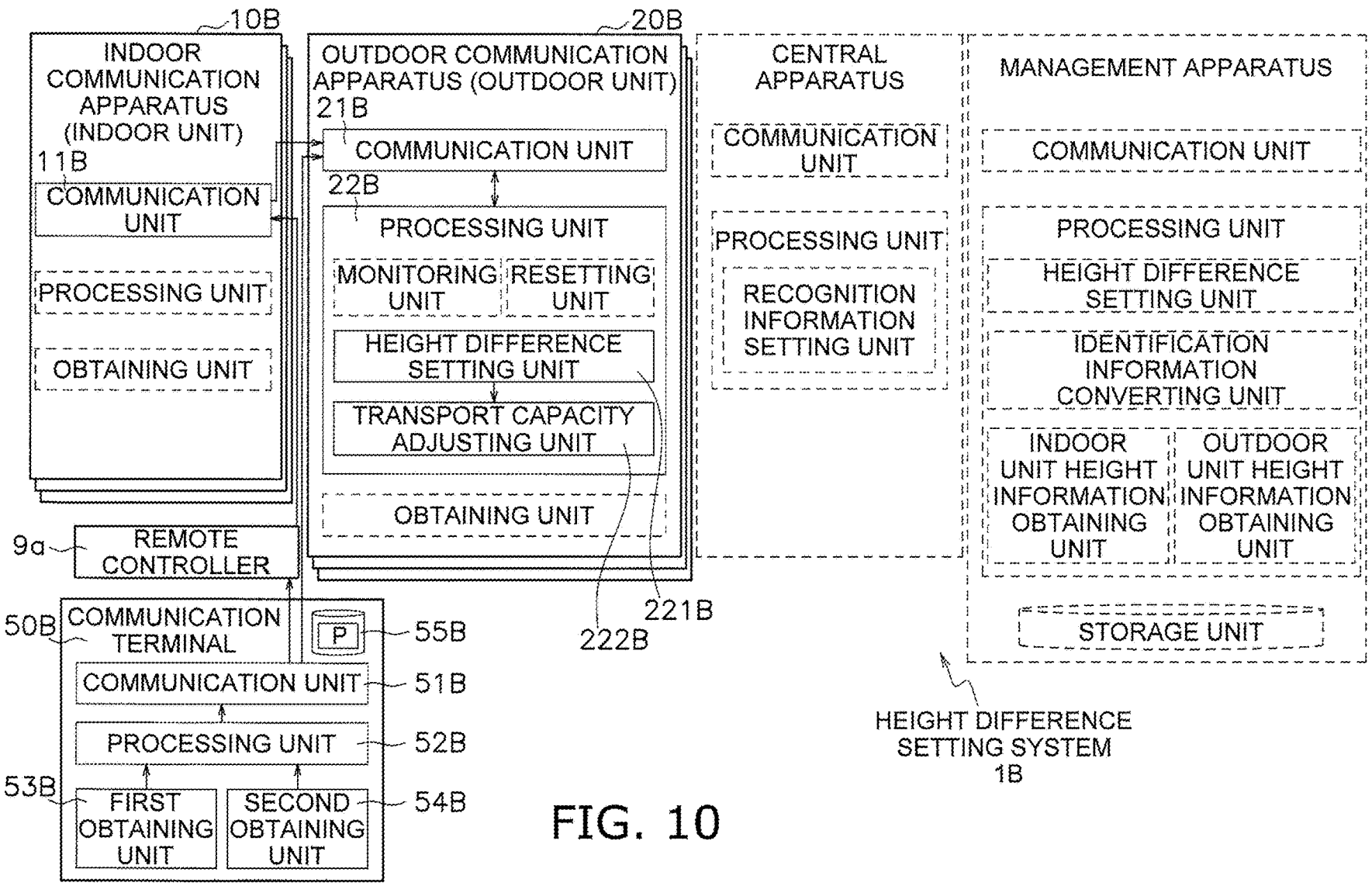
FIG. 10 is a schematic diagram illustrating a configuration of the height difference setting system 1B according to the modification 2B.

The height difference setting system 1B according to this embodiment may have a configuration in which indoor unit height information is transmitted via a remote controller 9*a* for operating the indoor unit 9, as illustrated in FIGS. 9 and 10. Here, the remote controller 9*a* has a near field wireless communication function (NFC function) and is capable of wirelessly communicating with a peripheral device.

(2-4-3) Modification 2C

In the description given above, the communication terminal 50B obtains outdoor unit height information and indoor unit height information by using a GPS sensor or the like, but the height difference setting system 1B according to this embodiment is not limited to this configuration. For example, when a two-dimensional code including indoor unit height information corresponding to the indoor unit 9B is displayed on the surface or the like of the indoor unit 9B, the communication terminal 50B may read the two-dimensional code to obtain the indoor unit height information. In this case, the second obtaining unit 54B of the communication terminal 50B is constituted by a two-dimensional code reader or the like.

By making such a two-dimensional code (for example, QR code (registered trademark) or the like) available, indoor unit height information can be easily obtained. Accordingly, it is possible to provide the height difference setting system 1B capable of reducing the work load of an on-site worker.

(2-4-4) Modification 2D

The height difference setting system 1B according to this embodiment may further include a central apparatus 30B and a management apparatus 40B.

Figure 11:
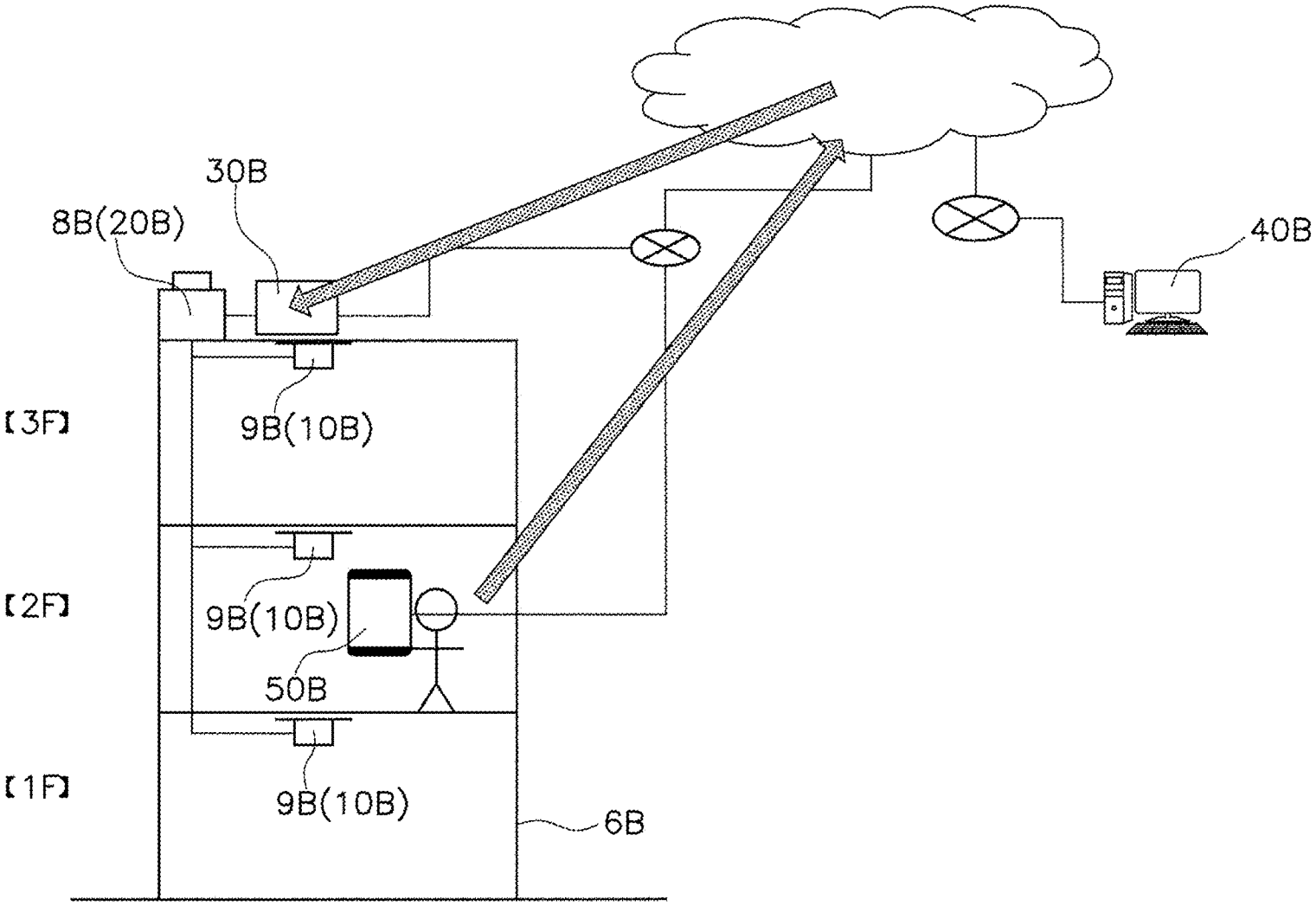
FIG. 11 is a schematic diagram illustrating a concept of a height difference setting system 1B according to a modification 2D.
Figure 12:
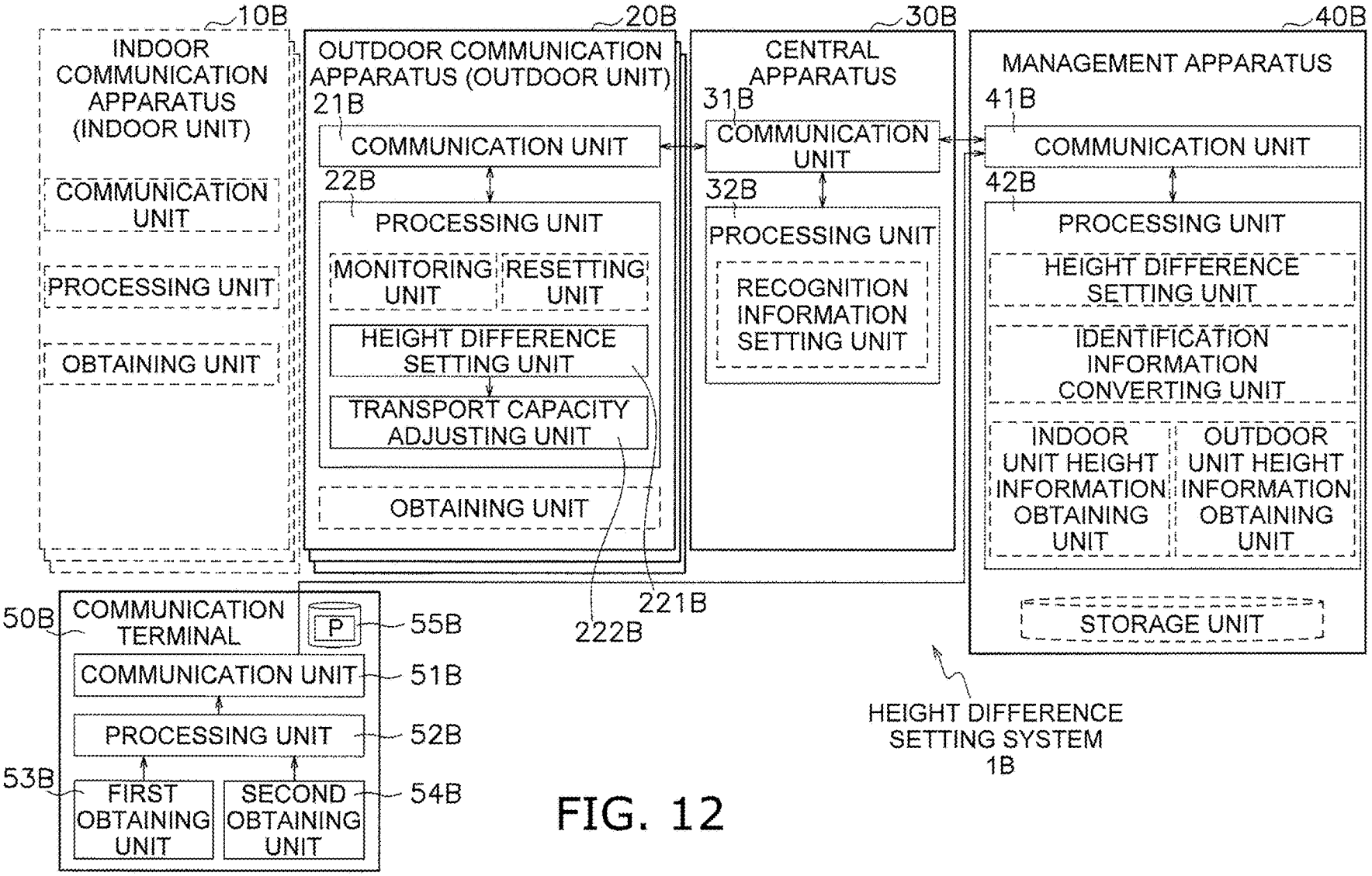
FIG. 12 is a schematic diagram illustrating a configuration of the height difference setting system 1B according to the modification 2D.

FIG. 11 is a schematic diagram illustrating a concept of a height difference setting system 1B according to a modification 2D of the present invention. FIG. 12 is a schematic diagram illustrating a configuration of the height difference setting system 1B according to the modification 2D.

In the height difference setting system 1B according to the modification 2D, the communication terminal 50B transmits indoor unit height information and outdoor unit height information having the content illustrated in FIG. 13 to the management apparatus 40B, in association with identification information D of the outdoor unit 8B and the indoor unit 9B. Subsequently, the management apparatus 40B transmits the indoor unit height information and the outdoor unit height information to the outdoor communication apparatus 20B via the central apparatus 30B. At this time, the central apparatus 30B recognizes the outdoor unit 8B and the indoor unit 9B on the basis of the identification information D. The identification information D can be set via the central apparatus 30B and/or the communication terminal 50B.

In the height difference setting system according to the modification 2D, which has the above-described configuration, the communication terminal 50B is capable of transmitting information to the outdoor communication apparatus 20B via the management apparatus 40B and the central apparatus 30B without directly communicating with the outdoor communication apparatus 20B and the indoor communication apparatus 10B.

(2-4-5) Modification 2E

In the description given above, the first obtaining unit 53B and the second obtaining unit 54B of the communication terminal 50B are each constituted by a height sensor, such as a GPS sensor, a geomagnetic sensor, or an atmospheric pressure sensor, but the height difference setting system 1B according to this embodiment is not limited to this configuration. For example, the first obtaining unit 53B and the second obtaining unit 54B of the communication terminal 50B may display a height selection screen or the like on a display unit, receive input of a floor setting of the building 6B, and obtain height information estimated by the floor setting as outdoor unit height information and indoor unit height information.

Third Embodiment

(3-1) Configuration of Height Difference Setting System 1C

Figure 14:
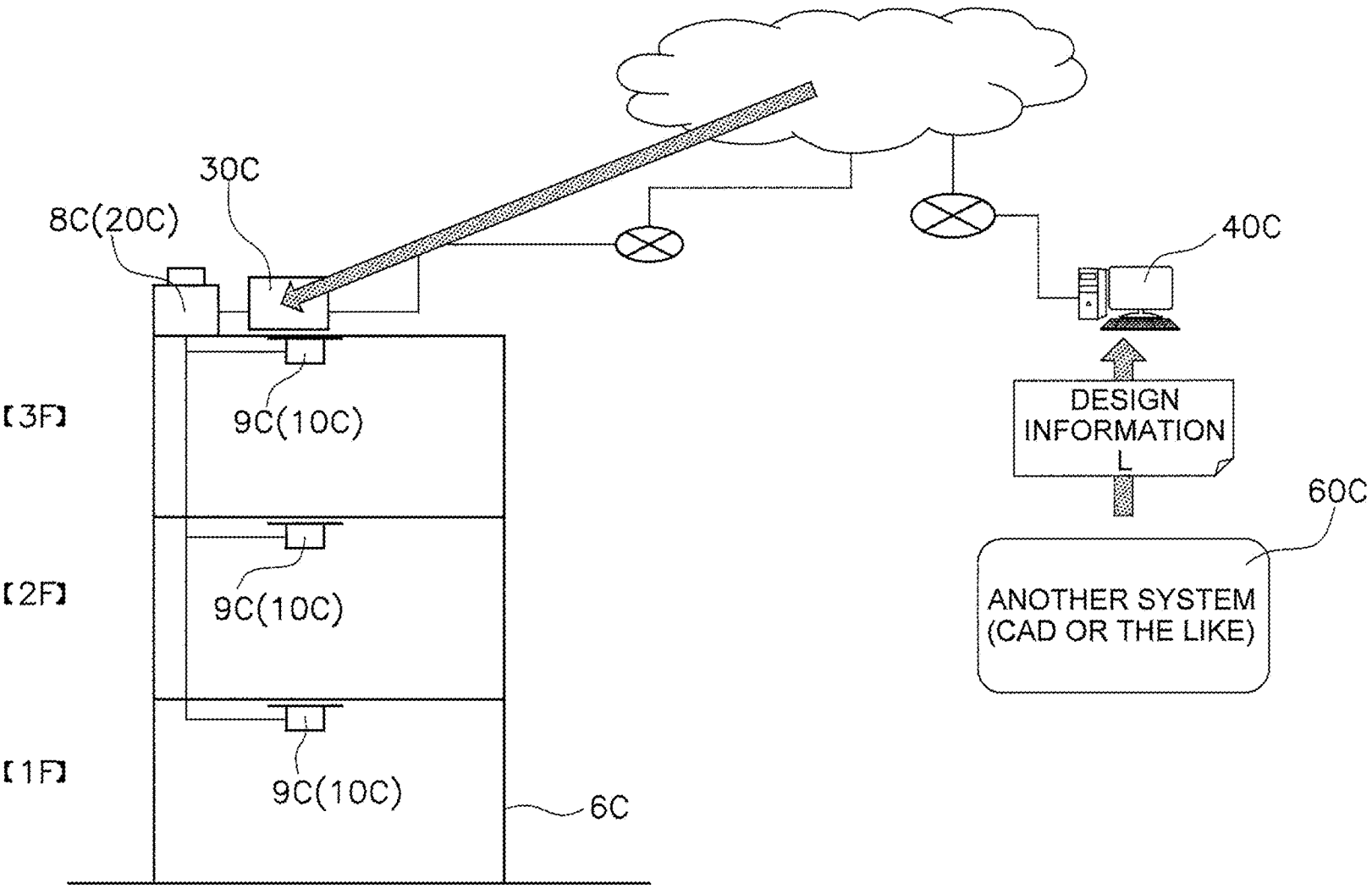
FIG. 14 is a schematic diagram illustrating a concept of a height difference setting system 1C according to a third embodiment of the present invention.
Figure 15:
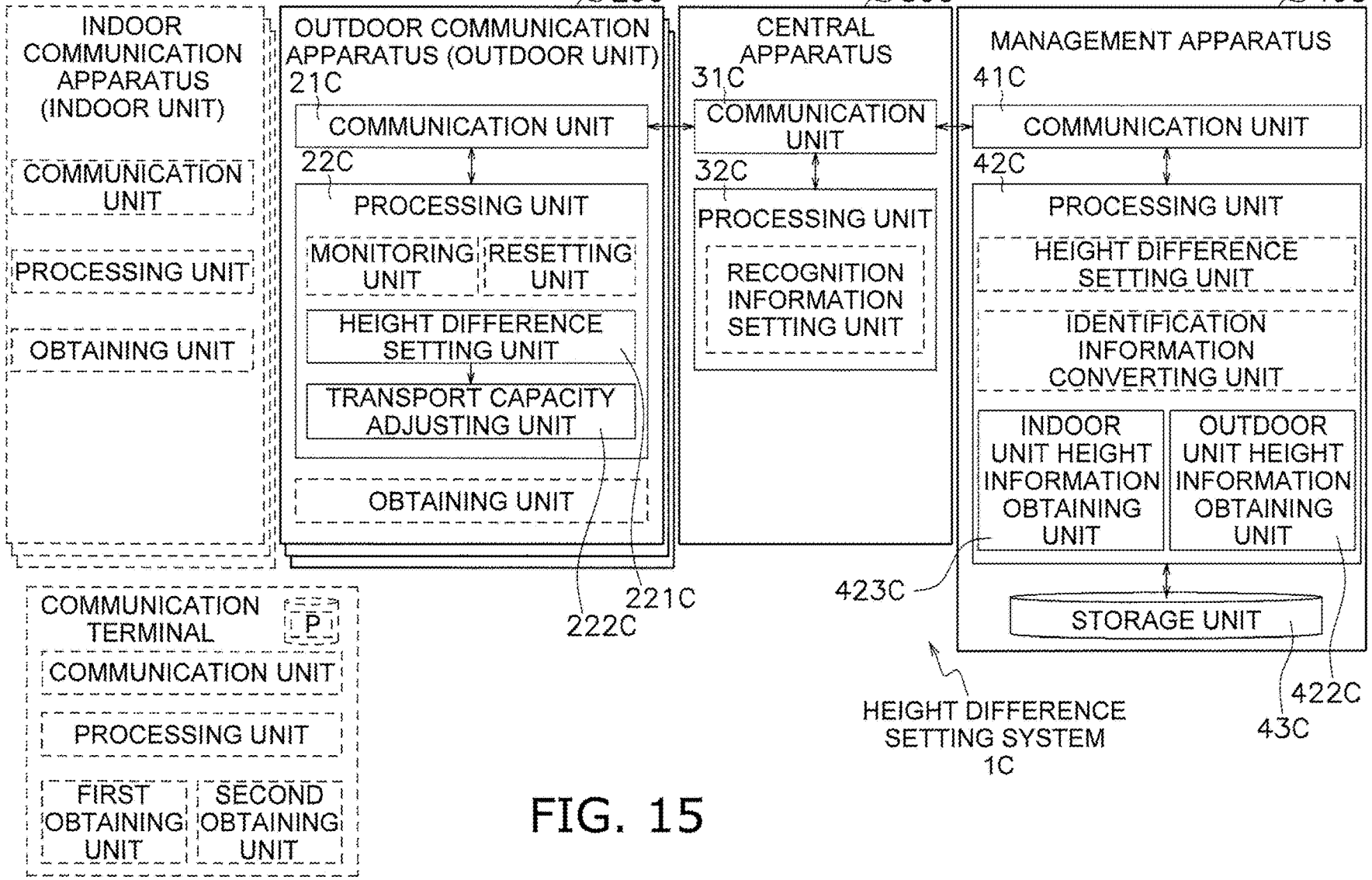
FIG. 15 is a schematic diagram illustrating a configuration of the height difference setting system 1C according to the third embodiment.

FIG. 14 is a schematic diagram illustrating a concept of a height difference setting system 1C according to a third embodiment of the present invention. FIG. 15 is a schematic diagram illustrating a configuration of the height difference setting system 1C according to the third embodiment.

The height difference setting system 1C according to this embodiment includes a management apparatus 40C. In the height difference setting system 1C according to this embodiment, the outdoor unit height information obtaining unit 2 and the indoor unit height information obtaining unit 3 are located in the management apparatus 40C. The height difference setting unit 4 and the transport capacity adjusting unit 5 are located in an outdoor communication apparatus 20C.

Hereinafter, the configuration of the height difference setting system 1C according to this embodiment will be described in more detail. The height difference setting system 1C according to this embodiment includes the outdoor communication apparatus 20C, a central apparatus 30C, and the management apparatus 40C.

The outdoor communication apparatus 20C is an apparatus housed in an outdoor unit 8C and includes a communication unit 21C and a processing unit 22C. The outdoor communication apparatus 20C also includes a storage unit that stores various pieces of information and that is not illustrated.

The communication unit 21C communicates with the central apparatus 30C. The communication unit 21C is also capable of communicating with the management apparatus 40C without via the central apparatus 30C.

The processing unit 22C performs various information processing operations in the outdoor communication apparatus 20C and has functions as a height difference setting unit 221C (corresponding to the height difference setting unit 4) and a transport capacity adjusting unit 222C (corresponding to the transport capacity adjusting unit 5). That is, the processing unit 22C sets the height difference between the outdoor unit 8C and an indoor unit 9C on the basis of the outdoor unit height information and indoor unit height information obtained by the management apparatus 40C, which will be described below, and adjusts the transport capacity of refrigerant to be transported from the outdoor unit 8B to the indoor unit 9C.

The central apparatus 30C includes a communication unit 31C and a processing unit 32C and relays communication between the outdoor communication apparatus 20C and the management apparatus 40C. The central apparatus 30C also includes a storage unit that stores various pieces of information and that is not illustrated.

The management apparatus 40C manages many air conditioners 7C through a network and includes a communication unit 41C, a processing unit 42C, and a storage unit 43C.

The communication unit 41C communicates with the central apparatus 30C. The communication unit 41C is also capable of communicating with the outdoor communication apparatus 20C without via the central apparatus 30C. The management apparatus 40C transmits indoor unit height information and outdoor unit height information to the outdoor communication apparatus 20C by using the communication unit 41C.

The processing unit 42C performs various information processing operations of the management apparatus 40C and has functions as an outdoor unit height information obtaining unit 422C (corresponding to the outdoor unit height information obtaining unit 2) and an indoor unit height information obtaining unit 423C (corresponding to the indoor unit height information obtaining unit 3). With use of these functions, the processing unit 42C extracts indoor unit height information and outdoor unit height information from design information L, which will be described below.

The storage unit 43C is constituted by a volatile memory, a nonvolatile memory, and the like, and stores "design information L" about a building 6C on or in which the outdoor unit 8C and the indoor unit 9C are installed. Here, the design information L is information including outdoor unit height information and indoor unit height information associated with "identification information D" capable of uniquely identifying the outdoor unit 8C and the indoor unit 9C, as illustrated in FIG. 16. The design information L can be obtained from an external system 60C or the like connected through a network. The design information L is stored in the format of image data available in CAD or the like. The storage unit 43C stores other various pieces of information.

(3-2) Height Difference Setting by Height Difference Setting System 1C

Figure 17:
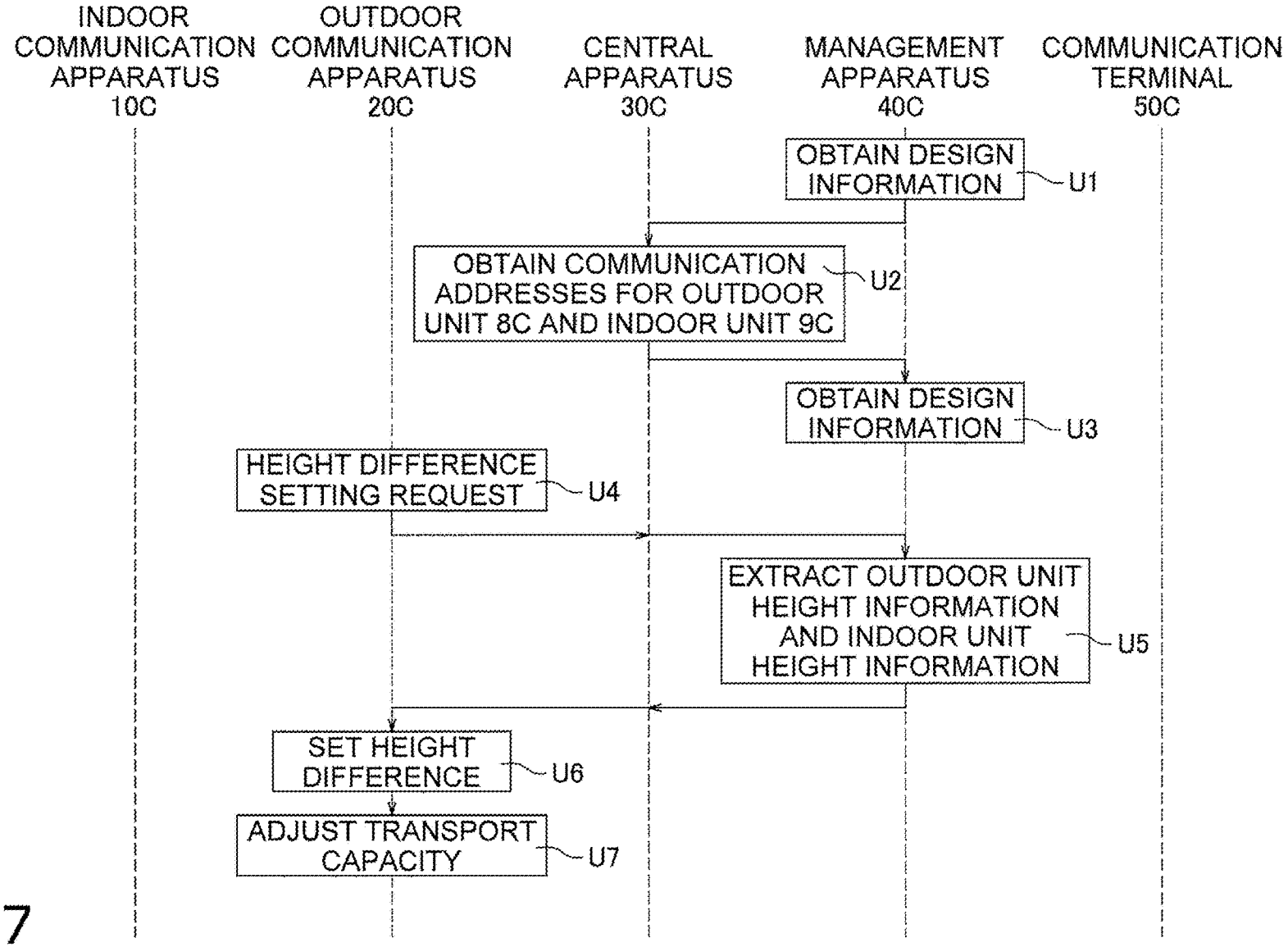
FIG. 17 is a sequence diagram illustrating an operation of height difference setting in the height difference setting system 1C according to the third embodiment.

Height difference setting in the height difference setting system 1C according to this embodiment will be described with reference to the sequence diagram illustrated in FIG. 17.

As an assumption, the management apparatus 40C obtains design information from the external system 60C or the like through a network (U1). The outdoor unit height information and indoor unit height information included in the design information at this time are associated with arbitrary identification information. The management apparatus 40C also obtains communication addresses for the outdoor unit 8C and the indoor unit 9C at the initial setting of the central apparatus 30C (U2). Subsequently, the management apparatus 40C associates the identification information obtained in step U1 with the communication addresses obtained in step U2. Accordingly, the design information as illustrated in FIG. 16, including the outdoor unit height information and indoor unit height information associated with the identification information capable of uniquely identifying the outdoor unit 8C and the indoor unit 9C, is obtained. Subsequently, the management apparatus 40C stores the design information in the storage unit 43C (U3).

After that, the outdoor unit 8C and the indoor units 9C are installed at predetermined positions of the building 6C by an on-site worker or the like, and then a test operation of the outdoor unit 8C and the indoor units 9C is performed. In the test operation, the indoor units 9C are operated one by one, and it is determined whether or not the corresponding outdoor unit 8C normally operates, whether or not cool air and warm air come out, whether or not a wind direction control button and an air volume control button function, and so forth.

In the test operation, a height difference setting request is transmitted by the on-site worker or the like from the outdoor communication apparatus 20C to the management apparatus 40C via the central apparatus 30C (U4).

Upon receiving the height difference setting request, the management apparatus 40C extracts, from the design information L stored in the storage unit 43C, the outdoor unit height information corresponding to the installed outdoor unit 8C and the indoor unit height information of the indoor unit 9C associated with the outdoor unit 8C (U5). Subsequently, the outdoor unit height information and the indoor unit height information are transmitted from the management apparatus 40C to the outdoor communication apparatus 20C via the central apparatus 30C.

Subsequently, in the outdoor communication apparatus 20C, the processing unit 22C calculates, with use of the function of the height difference setting unit 221C, height difference information indicating the height difference between the outdoor unit 8C and the indoor unit 9C on the basis of the outdoor unit height information and the indoor unit height information (U6). Here, when a plurality of indoor units 9C are associated with the outdoor unit 8C, the processing unit 22C calculates height difference information between the outdoor unit 8C and the indoor unit 9C that has the largest height difference from the outdoor unit 8C. Subsequently, the outdoor communication apparatus 20C sets the transport capacity of refrigerant to be transported from the outdoor unit 8C to the indoor unit 9C in accordance with the calculated height difference information (U7). The outdoor communication apparatus 20C stores in advance, in a memory or the like, correspondence information indicating the correspondence between height difference information and adjustment amounts of transport capacity, and sets the transport capacity on the basis of the correspondence information.

(3-3) Characteristics

As described above, in the height difference setting system 1C according to the third embodiment, the height difference between the outdoor unit 8C and one or more indoor units 9C associated with the outdoor units 8C is managed by the management apparatus 40C that communicates with either or both of the outdoor unit 8C and each of the one or more indoor units 9C.

Here, in the height difference setting system 1C according to this embodiment, the storage unit 43C (design information storage unit) of the management apparatus 40 stores "design information L" about the building 6C on or in which the outdoor unit 8C and the indoor unit 9C are installed. The processing unit 42 of the management apparatus 40C obtains, with use of the function of the outdoor unit height information obtaining unit 422C, "outdoor unit height information" indicating the height of the installation place of the outdoor unit 8C on the basis of the design information L stored in the storage unit 43C. Also, the processing unit 42 of the management apparatus 40C obtains, with use of the function of the indoor unit height information obtaining unit 423C, "indoor unit height information" indicating the height of the installation place of the indoor unit 9C on the basis of the design information L stored in the storage unit 43C. The height difference setting unit 221C of the outdoor communication apparatus 20C sets the height difference between the outdoor unit 8C and the indoor unit 9C on the basis of the outdoor unit height information and the indoor unit height information. The transport capacity adjusting unit 222C of the outdoor communication apparatus 20C adjusts the transport capacity of refrigerant to be transported from the outdoor unit 8C to the indoor unit 9C on the basis of the height difference set by the height difference setting unit 221C.

In short, the height difference setting system 1C according to this embodiment is capable of setting the height difference between the outdoor unit 8C and the indoor unit 9C on the basis of the design information L about the building 6C. The height difference setting system 1C according to this embodiment adjusts the transport capacity of refrigerant on the basis of the height difference, and is thus capable of setting the transport capacity of refrigerant in an appropriate state. In other words, in the height difference setting system 1C according to this embodiment, the transport capacity of refrigerant is adjusted in an appropriate state, which makes it is possible to avoid an increase in power consumption caused by setting of an excessive transport capacity. Also, in the height difference setting system 1C according to this embodiment, an inappropriate cooling operation or heating operation caused by an insufficient transport capacity can be avoided.

Furthermore, in the height difference setting system 1C according to this embodiment, the processing unit 42C of the management apparatus 40C is capable of automatically obtaining, with use of the functions of the outdoor unit height information obtaining unit 422C and the indoor unit height information obtaining unit 423C, indoor unit height information and outdoor unit height information at the time of installing the outdoor unit 8C and the indoor unit 9C on or in the building 6C. Accordingly, the height difference setting system 1C has effects (i) a man-hour for input to set a height difference can be reduced, (ii) input mistakes can be eliminated when an on-site worker sets a height difference, and (iii) a situation can be prevented from occurring where a height difference is not set by an on-site worker.

(3-4) Modifications (3-4-1) Modification 3A

In the height difference setting system 1C according to this embodiment, the management apparatus 40C stores, as the design information L, information including outdoor unit height information and indoor unit height information associated with the identification information D capable of uniquely identifying the outdoor unit 8C and the indoor unit 9C, but the height difference setting system 1C according to this embodiment is not limited to this configuration.

Figure 18:
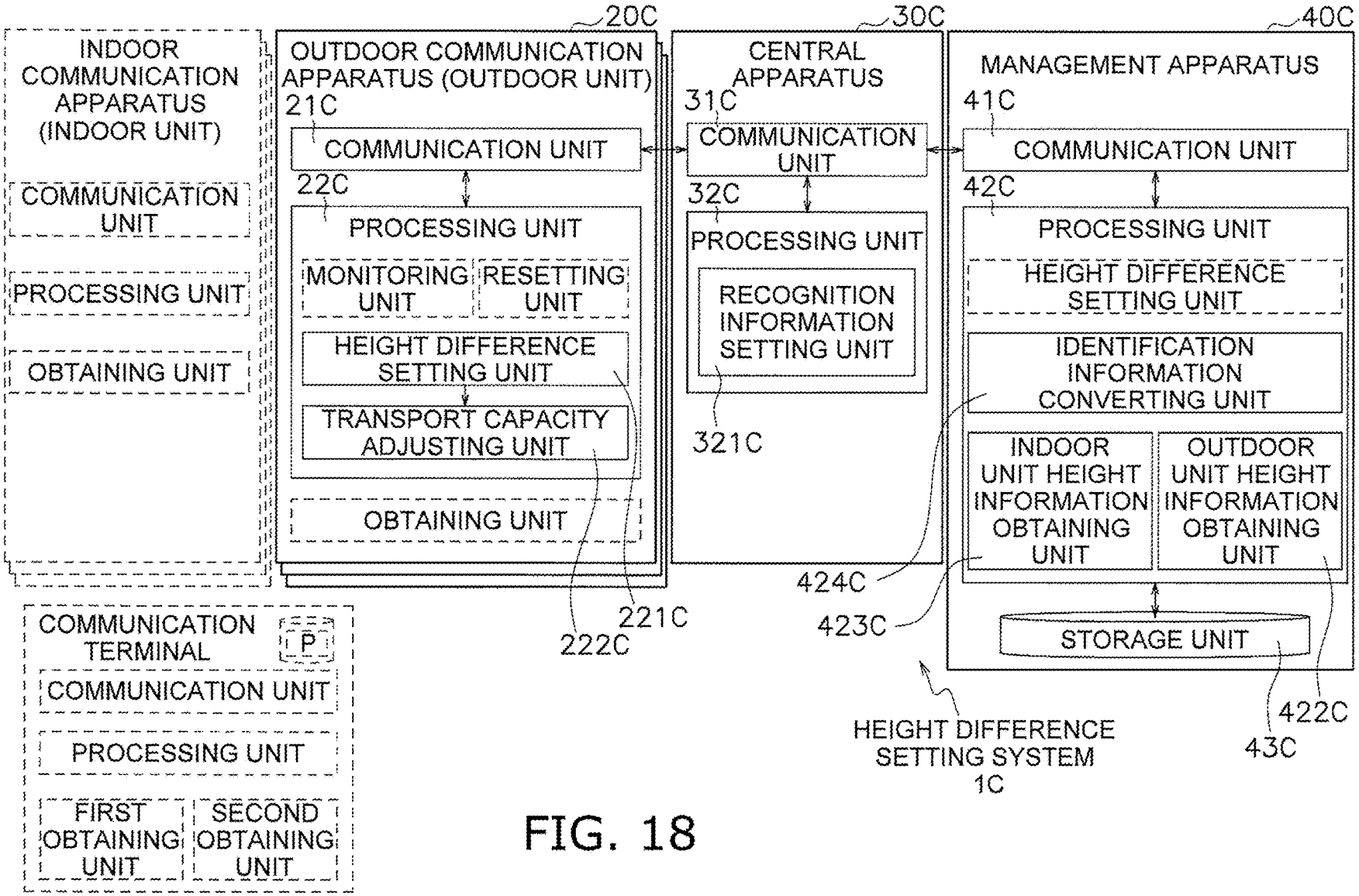
FIG. 18 is a schematic diagram illustrating a configuration of a height difference setting system 1C according to a modification 3A.

For example, in the height difference setting system 1C, the processing unit 32C of the central apparatus 30C may have a function of an identification information setting unit 321C, and the processing unit 42C of the management apparatus 40C may have a function of an identification information converting unit 424C, as illustrated in FIG. 18.

The identification information setting unit 321C of the central apparatus 30C sets first identification information D1 for each of the outdoor unit 8C and the indoor unit 9C at the time of installing the outdoor unit 8C and the indoor unit 9C on or in the building 6C. Here, the first identification information D1 is identification information that uniquely identifies each of the outdoor unit 8C and the indoor unit 9C.

The storage unit 43C of the management apparatus 40C stores, as illustrated in FIG. 19, "design information L" including outdoor unit height information and indoor unit height information in association with second identification information D2 that is set in advance for the outdoor unit 8C and the indoor unit 9C.

The outdoor unit height information obtaining unit 422C and the indoor unit height information obtaining unit 423C of the management apparatus 40C obtain the second identification information D2 that is set in advance for the outdoor unit 8C and the indoor units 9C, and the outdoor unit height information and indoor unit height information associated with the second identification information D2, from the design information L. These pieces of information are transmitted to the identification information converting unit 424C.

The identification information converting unit 424C of the management apparatus 40C converts the second identification information D2 into the first identification information D1 and generates outdoor unit height information and indoor unit height information that are associated with the first identification information D1. Subsequently, the identification information converting unit 424C transmits the outdoor unit height information and indoor unit height information that are associated with the first identification information D1 to the outdoor communication apparatus 20C via the central apparatus 30C.

Thus, in the height difference setting system 1C according to the modification 3A, the second identification information D2 that is set in advance on the basis of the design information L about the building 6C is converted into the first identification information D1 that is set by an on-site worker or the like at the time of installing the outdoor unit 8C and the indoor unit 9C, and thus the transport capacity of refrigerant can be set in an appropriate state even when the second identification information D2 is not identical to the first identification information D1. In other words, even when the design information L includes the second identification information D2 different from the first identification information D1 that is set by a worker or the like, the height difference setting system 1C according to the modification 3A, which includes the identification information converting unit 424C, is capable of obtaining outdoor unit height information and indoor unit height information in association with the first identification information D1 that is set by the on-site worker or the like.

(3-4-2) Modification 3B

In the description given above, a height difference is set on the basis of height information about the outdoor unit 8C and the indoor unit 9C, but the height difference may be set by reflecting information other than heights. For example, when "design information L" stored in the management apparatus 40C includes information indicating the length of a refrigerant pipe, the shape of the refrigerant pipe that is bent, and so forth, the height difference may be set by taking these pieces of information into account. This makes it possible to set a more appropriate height difference (transport capacity of refrigerant).

Fourth Embodiment

In a height difference setting system 1D according to a fourth embodiment of the present invention, a processing unit 22D of an outdoor communication apparatus 20D has functions as a monitoring unit 223D and a resetting unit 224D. Except for this, the configuration of the height difference setting system 1D according to this embodiment is similar to the configurations of the height difference setting systems according to the first embodiment to the third embodiment.

Figure 20:
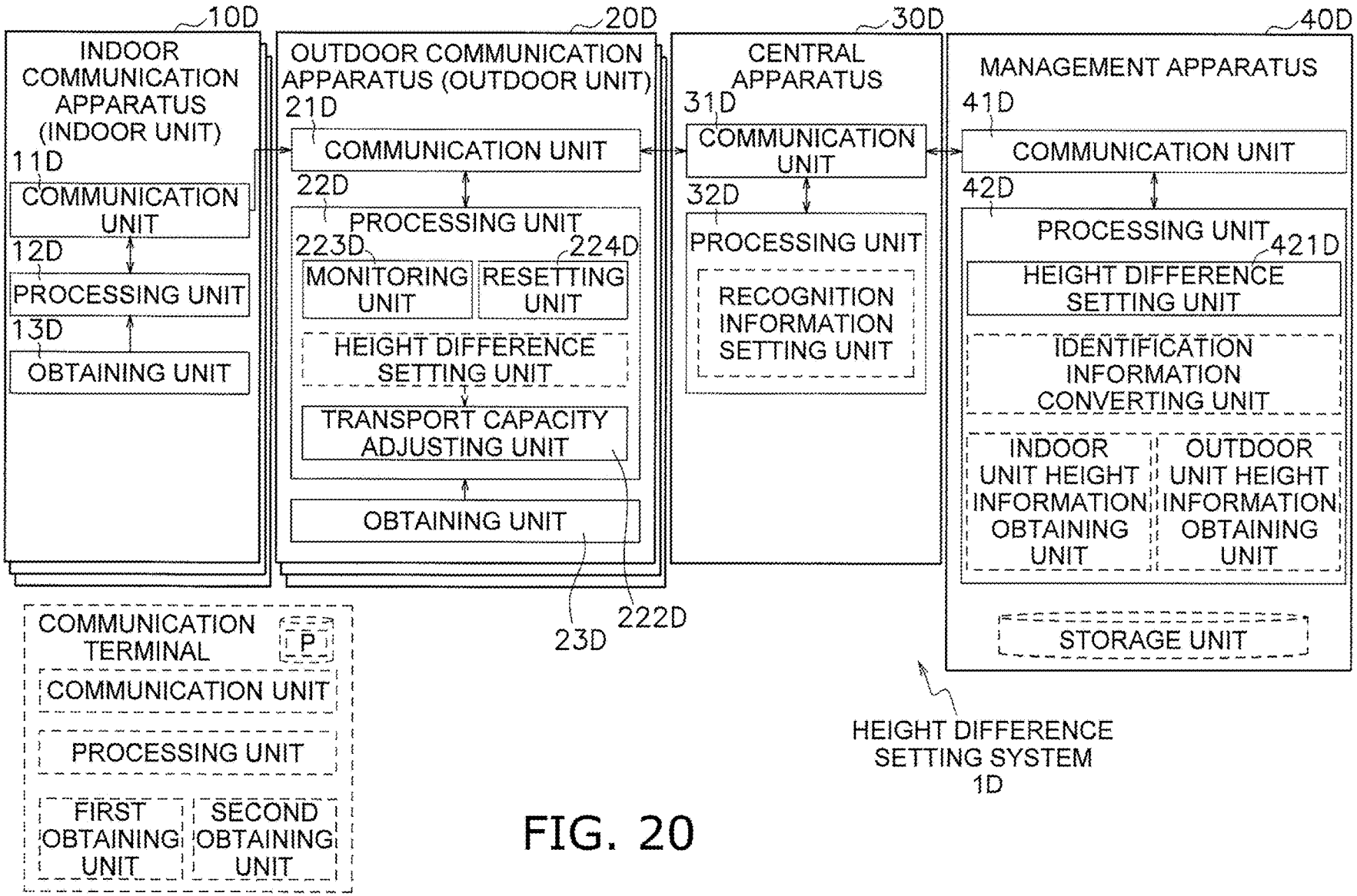
FIG. 20 is a schematic diagram illustrating a configuration of a height difference setting system 1D according to a fourth embodiment of the present invention.
Figure 21:
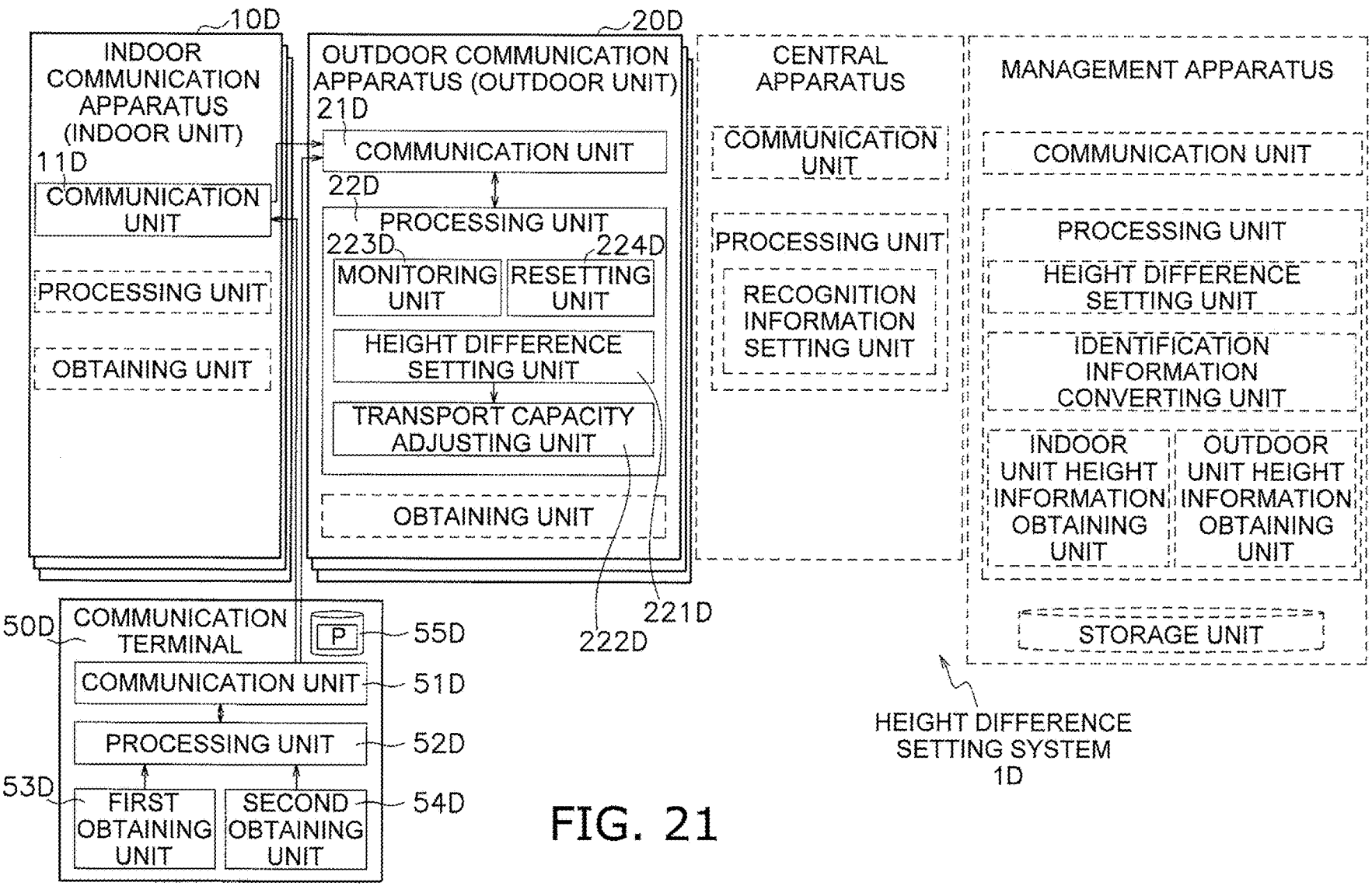
FIG. 21 is a schematic diagram illustrating a configuration of the height difference setting system 1D according to the fourth embodiment of the present invention.
Figure 22:
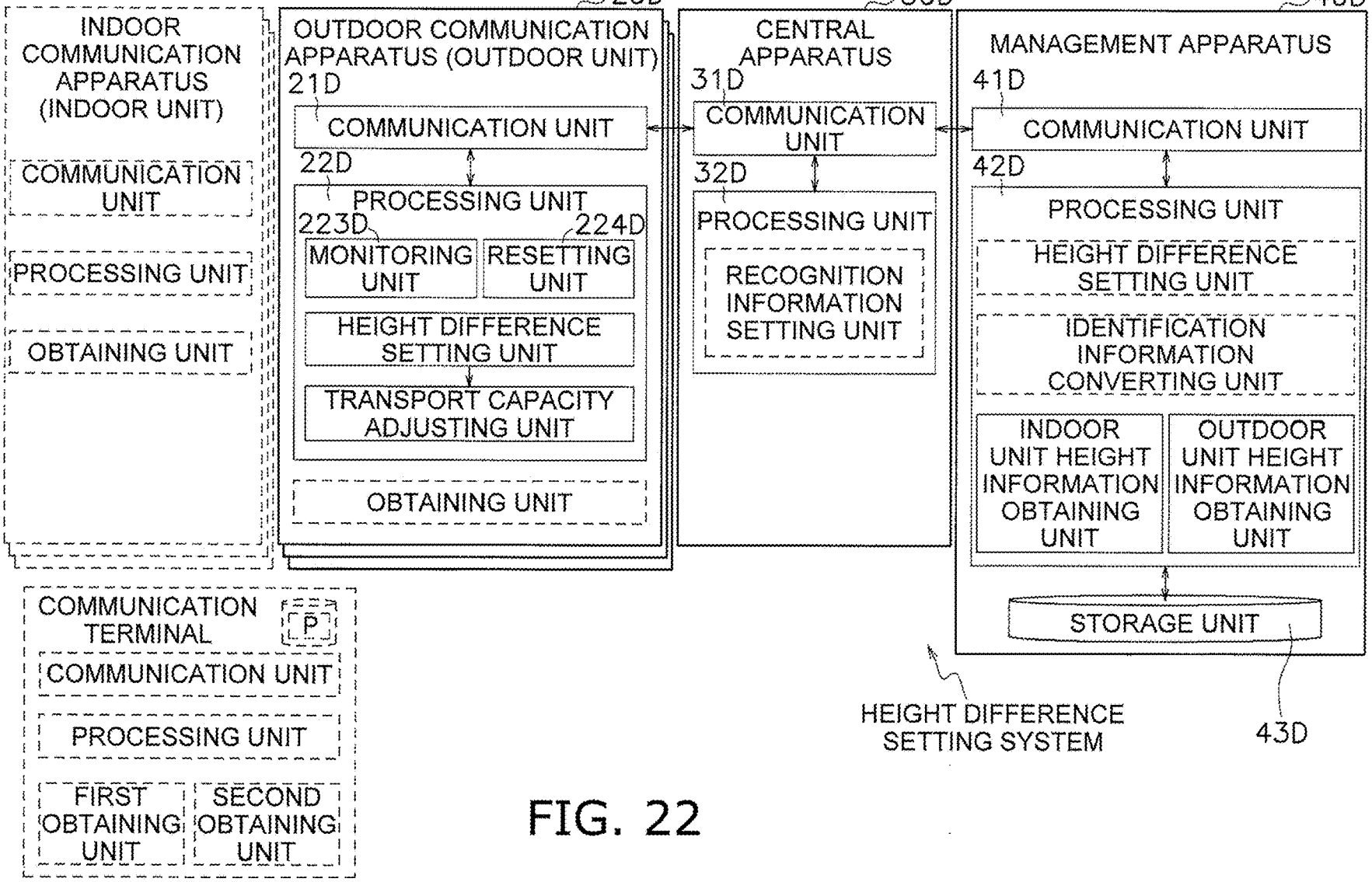
FIG. 22 is a schematic diagram illustrating a configuration of the height difference setting system 1D according to the fourth embodiment of the present invention.

Thus, the height difference setting system 1D according to the fourth embodiment of the present invention has the configuration illustrated in FIG. 20, 21, or 22, for example. FIG. 20 illustrates the height difference setting system 1D having a configuration similar to that of the height difference setting system 1A according to the first embodiment. FIG. 21 illustrates the height difference setting system 1D having a configuration similar to that of the height difference setting system 1B according to the second embodiment. FIG. 22 illustrates the height difference setting system 1D having a configuration similar to that of the height difference setting system 1C according to the third embodiment. The height difference setting system 1D according to this embodiment is not limited to these configurations, and may have any configuration as long as the processing unit 22D of the outdoor communication apparatus 20D has functions as the monitoring unit 223D and the resetting unit 224D.

The processing unit 22D of the outdoor communication apparatus 20D regularly monitors, with use of the function of the monitoring unit 223D, the operation conditions of an indoor unit 9D.

The processing unit 22D of the outdoor communication apparatus 20D resets, with use of the function of the resetting unit 224D, the height difference between an outdoor unit 8D and the indoor unit 9D on the basis of the operation conditions of the indoor unit 9D monitored by the monitoring unit 223D.

The processing unit 22D of the outdoor communication apparatus 20D adjusts, with use of the function of a transport capacity adjusting unit 222D, the transport capacity of refrigerant to be transported from the outdoor unit 8D to the indoor unit 9D on the basis of the height difference reset by the resetting unit 224D.

With the above-described configuration, the height difference setting system 1D according to this embodiment regularly resets the height difference in accordance with the operation conditions of the indoor unit 9D. Thus, the height difference setting system 1D optimizes the transport capacity of refrigerant to be transported from the outdoor unit 8D to the indoor unit 9D as necessary after the outdoor unit 8D and the indoor unit 9D are installed.

In short, in the height difference setting system 1D according to this embodiment, a situation can be prevented from occurring where the transport capacity of refrigerant become inappropriate even after a height difference is once set. In addition, in the height difference setting system 1D according to this embodiment, the transport capacity of refrigerant is adjusted in an appropriate state, which makes it is possible to avoid an increase in power consumption caused by setting of an excessive transport capacity. Also, in the height difference setting system 1D according to this embodiment, an inappropriate cooling operation or heating operation caused by an insufficient transport capacity can be avoided.

Supplementary Note

The present invention is not limited to the above-described embodiments as is. The present invention can be embodied, in the stage of implementation, by modifying components without deviating from the gist thereof. In the present invention, a plurality of components disclosed in the above-described embodiments may be appropriately combined to form various inventions. For example, some of all the components illustrated in the embodiments may be eliminated. Furthermore, components in different embodiments may be appropriately combined.

REFERENCE SIGNS LIST

1 height difference setting system
2 outdoor unit height information obtaining unit
3 indoor unit height information obtaining unit
4 height difference setting unit
5 transport capacity adjusting unit
6 building
7 air conditioner
8 outdoor unit
9 indoor unit
9*a* remote controller
10 indoor communication apparatus
11 communication unit
12 processing unit
13 obtaining unit
20 outdoor communication apparatus
21 communication unit
22 processing unit
221 height difference setting unit
222 transport capacity adjusting unit
223 monitoring unit
224 resetting unit
23 obtaining unit
30 central apparatus
31 communication unit
32 processing unit
321 identification information setting unit
40 management apparatus
41 communication unit
42 processing unit
421 height difference setting unit
422 outdoor unit height information obtaining unit
423 indoor unit height information obtaining unit
424 identification information converting unit
43 storage unit
50 communication terminal
51 communication unit
52 processing unit
53 first obtaining unit
54 second obtaining unit
55 storage unit
60 external system
D1 first identification information
D2 second identification information
L design information
P communication terminal program

CITATION LIST

Patent Literature

<Patent Literature 1> Japanese Unexamined Patent Application Publication No. 10-153335

The invention claimed is:

1. A height difference setting system in which a height difference between an outdoor unit and one or more indoor units associated with the outdoor unit is set by a management apparatus that communicates with either or both of the outdoor unit and each of the one or more indoor units, the height difference setting system comprising:

an outdoor unit height information obtaining unit that obtains outdoor unit height information indicating a height of an installation place of the outdoor unit;

an indoor unit height information obtaining unit that obtains indoor unit height information indicating a height of an installation place of the indoor unit;

a height difference setting unit that sets a height difference between the outdoor unit and the indoor unit on the basis of the outdoor unit height information and the indoor unit height information; and a transport capacity adjusting unit that adjusts, on the basis of the height difference set by the height difference setting unit, a transport capacity of refrigerant to be transported from the outdoor unit to the indoor unit, wherein the outdoor unit height information obtaining unit and the transport capacity adjusting unit are located in the outdoor unit, the indoor unit height information obtaining unit is housed in the indoor unit, and the height difference setting unit is located in the management apparatus.

2. A height difference setting system in which a height difference between an outdoor unit and one or more indoor units associated with the outdoor unit is set by using a predetermined communication terminal that is capable of communicating with the outdoor unit and each of the one or more indoor units, the height difference setting system comprising:

an outdoor unit height information obtaining unit that obtains outdoor unit height information indicating a height of an installation place of the outdoor unit;

an indoor unit height information obtaining unit that obtains indoor unit height information indicating a height of an installation place of the indoor unit;

a height difference setting unit that sets a height difference between the outdoor unit and the indoor unit on the basis of the outdoor unit height information and the indoor unit height information; and a transport capacity adjusting unit that adjusts, on the basis of the height difference set by the height difference setting unit, a transport capacity of refrigerant to be transported from the outdoor unit to the indoor unit, wherein the outdoor unit height information obtaining unit and the indoor unit height information obtaining unit are located in the communication terminal, the height difference setting unit and the transport capacity adjusting unit are located in the outdoor unit, and the indoor unit height information is transmitted from the communication terminal to the outdoor unit via the indoor unit.

3. The height difference setting system according to claim 2, wherein the indoor unit is connected to a remote controller capable of wirelessly communicating with a peripheral device, and the indoor unit height information is transmitted from the communication terminal to the remote controller through wireless communication and is transmitted to the outdoor unit via the remote controller and the indoor unit.

4. The height difference setting system according to claim 2, wherein the outdoor unit and the indoor unit are managed by a management apparatus that communicates with the outdoor unit, the management apparatus is capable of communicating with the predetermined communication terminal, the outdoor unit height information obtaining unit and the indoor unit height information obtaining unit are located in the communication terminal, the height difference setting unit is located in the outdoor unit, and the outdoor unit height information and the indoor unit height information are transmitted from the communication terminal to the outdoor unit via the management apparatus.

5. The height difference setting system according to claim 4, wherein the indoor unit has a two-dimensional code displayed thereon, the two-dimensional code including corresponding indoor unit height information, and the indoor unit height information obtaining unit reads the two-dimensional code to obtain the indoor unit height information.

6. A height difference setting system in which a height difference between an outdoor unit and one or more indoor units associated with the outdoor unit is set by a management apparatus that communicates with either or both of the outdoor unit and each of the one or more indoor units, the height difference setting system comprising:

an outdoor unit height information obtaining unit that obtains outdoor unit height information indicating a height of an installation place of the outdoor unit;

an indoor unit height information obtaining unit that obtains indoor unit height information indicating a height of an installation place of the indoor unit;

a height difference setting unit that sets a height difference between the outdoor unit and the indoor unit on the basis of the outdoor unit height information and the indoor unit height information;

a transport capacity adjusting unit that adjusts, on the basis of the height difference set by the height difference setting unit, a transport capacity of refrigerant to be transported from the outdoor unit to the indoor unit; and a design information storage unit that stores design information about a building on or in which the outdoor unit and the indoor unit are installed, wherein the outdoor unit height information obtaining unit and the indoor unit height information obtaining unit obtain the outdoor unit height information and the indoor unit height information, respectively, on the basis of the design information, the design information storage unit, the outdoor unit height information obtaining unit, and the indoor unit height information obtaining unit are located in the management apparatus, and the height difference setting unit and the transport capacity adjusting unit are located in the outdoor unit.

7. The height difference setting system according to claim 6, wherein the design information storage unit stores, as the design information, second identification information that is set in advance for the outdoor unit and the indoor unit, the outdoor unit height information obtaining unit and the indoor unit height information obtaining unit obtain, from the design information, the second identification information that is set in advance for the outdoor unit and the indoor unit, and outdoor unit height information and indoor unit height information that are associated with the second identification information, the height difference setting system further comprises:

an identification information setting unit that sets first identification information for each of the outdoor unit and the indoor unit at a time of installing the outdoor unit and the indoor unit on or in the building; and an identification information converting unit that converts the second identification information into the first identification information and obtains outdoor unit height information and indoor unit height information that are associated with the first identification information, the identification information setting unit is located in a setting apparatus connected to the outdoor unit and the management apparatus, and the identification information converting unit is located in the management apparatus.

8. The height difference setting system according to claim 1, further comprising:

a monitoring unit that monitors an operation condition of the indoor unit; and a resetting unit that resets the height difference between the outdoor unit and the indoor unit on the basis of the operation condition, wherein the transport capacity adjusting unit adjusts, on the basis of the height difference reset by the resetting unit, the transport capacity of the refrigerant to be transported from the outdoor unit to the indoor unit.

9. A communication terminal program for operating the communication terminal used in the height difference setting system according to claim 2, the communication terminal program causing a computer of the communication terminal to function as a communication unit that communicates with the outdoor unit and the indoor unit, the outdoor unit height information obtaining unit, and the indoor unit height information obtaining unit.

10. A communication terminal program for operating the communication terminal used in the height difference setting system according to claim 4, communication terminal program causing a computer of the communication terminal to function as a communication unit that communicates with the management apparatus, the outdoor unit height information obtaining unit, and the indoor unit height information obtaining unit.

11. The height difference setting system according to claim 2, further comprising:

a monitoring unit that monitors an operation condition of the indoor unit; and a resetting unit that resets the height difference between the outdoor unit and the indoor unit on the basis of the operation condition, wherein the transport capacity adjusting unit adjusts, on the basis of the height difference reset by the resetting unit, the transport capacity of the refrigerant to be transported from the outdoor unit to the indoor unit.

12. The height difference setting system according to claim 6, further comprising:

a monitoring unit that monitors an operation condition of the indoor unit; and a resetting unit that resets the height difference between the outdoor unit and the indoor unit on the basis of the operation condition, wherein the transport capacity adjusting unit adjusts, on the basis of the height difference reset by the resetting unit, the transport capacity of the refrigerant to be transported from the outdoor unit to the indoor unit.

* * * * *